US006737968B1

(12) United States Patent
Ergun et al.

(10) Patent No.: US 6,737,968 B1
(45) Date of Patent: May 18, 2004

(54) MOVABLE BARRIER OPERATOR HAVING PASSIVE INFRARED DETECTOR

(75) Inventors: Joseph J. Ergun, WoodDale, IL (US); Thomas Brookbank, Chicago, IL (US); Sandor Goldner, Brooklyn, NY (US); David Daly, White House Station, NJ (US)

(73) Assignee: The Chamberlain Group, Inc., Elmhurst, IL (US)

( * ) Notice: Subject to any disclaimer, the term of this patent is extended or adjusted under 35 U.S.C. 154(b) by 0 days.

(21) Appl. No.: 09/544,904

(22) Filed: Apr. 7, 2000

Related U.S. Application Data

(60) Provisional application No. 60/128,209, filed on Apr. 7, 1999.

(51) Int. Cl.[7] ..... G08B 21/00

(52) U.S. Cl. ..... 340/540; 340/545.1; 340/825.69; 340/542; 340/825.8; 49/26; 49/27; 49/29

(58) Field of Search ..... 340/540, 545.1, 340/825.69, 542, 825.8; 49/26, 27, 29

(56) References Cited

U.S. PATENT DOCUMENTS 4,549,092 A * 10/1985 Matsuoka et al. ..... 307/116
5,357,183 A * 10/1994 Lin ..... 318/468
5,589,747 A 12/1996 Utke ..... 318/468
5,625,980 A * 5/1997 Teich et al. ..... 49/26
5,656,900 A 8/1997 Michel et al. ..... 318/286
5,684,372 A * 11/1997 Fitzgibbon et al. ..... 318/280
5,752,343 A * 5/1998 Quintus ..... 49/29
5,933,091 A 8/1999 McCaslin ..... 340/825.72
5,969,637 A 10/1999 Dopplet et al. ..... 340/825.69

OTHER PUBLICATIONS

IP, Paul, *Notification of Transmittal of The International Search Report or The Declaration*, May 25, 2000 (4 pp).

* cited by examiner

*Primary Examiner*—Daniel J. Wu
*Assistant Examiner*—Tai T. Nguyen
(74) *Attorney, Agent, or Firm*—Fitch, Even, Tabin & Flannery

(57) ABSTRACT

A wall control unit for a movable barrier operator sends baseband signals over a wire connection to a head unit of a movable barrier operator to command the movable barrier to perform barrier operator functions. The wall control unit has a wall control unit port for connection to the wire connection. A first switch sends a barrier command signal to the head unit commanding the head unit to open or close a movable barrier. A second switch commands the head unit to provide energization to a light source. An infrared detector causes a command signal to be sent to the head unit to control the illumination state of the light source.

12 Claims, 16 Drawing Sheets

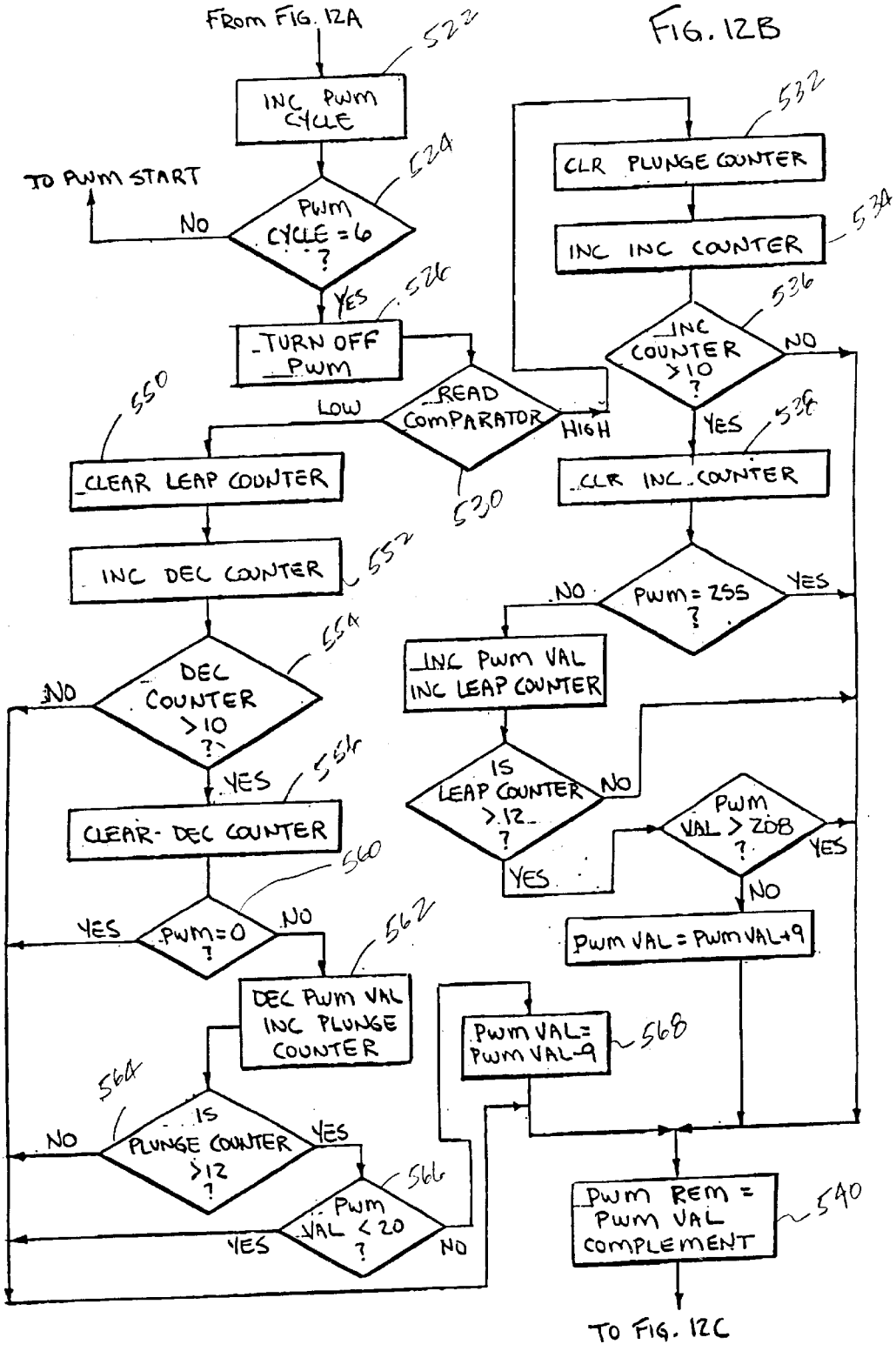
FIG. 12B
FROM FIG. 12A
522
INC PWM CYCLE
524
PWM CYCLE = 6 ?
TO PWM START
NO
YES
526
TURN OFF PWM
READ COMPARATOR
LOW
HIGH
530
550
CLEAR LEAP COUNTER
INC DEC COUNTER
552
554
DEC COUNTER > 10 ?
NO
YES
556
CLEAR DEC COUNTER
560
PWM = 0 ?
YES
NO
562
DEC PWM VAL INC PLUNGE COUNTER
564
IS PLUNGE COUNTER > 12 ?
NO
YES
566
PWM VAL < 20 ?
YES
NO
532
CLR PLUNGE COUNTER
534
INC INC COUNTER
536
INC COUNTER > 10 ?
NO
YES
538
CLR INC COUNTER
PWM = 255 ?
NO
YES
INC PWM VAL INC LEAP COUNTER
IS LEAP COUNTER > 12 ?
NO
YES
PWM VAL > 208 ?
YES
NO
PWM VAL = PWM VAL+9
PWM VAL = PWM VAL-9
568
PWM REM = PWM VAL COMPLEMENT
540
TO FIG. 12C

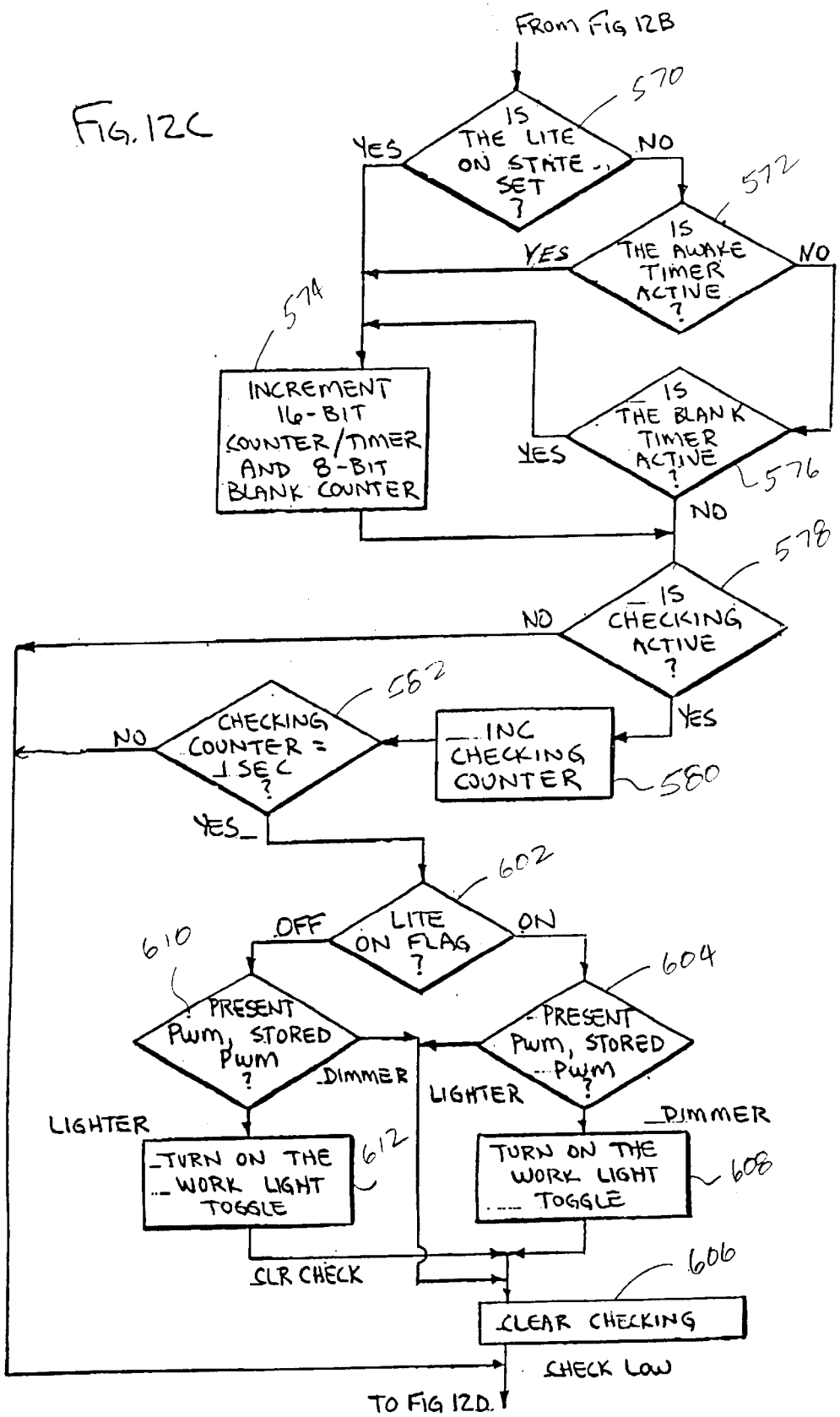
FIG. 12C
FROM FIG 12B
570
IS THE LITE ON STATE SET ?
YES
NO
572
IS THE AWAKE TIMER ACTIVE ?
YES
NO
574
INCREMENT 16-BIT COUNTER/TIMER AND 8-BIT BLANK COUNTER
IS THE BLANK TIMER ACTIVE ?
YES
576
NO
578
IS CHECKING ACTIVE ?
NO
YES
582
CHECKING COUNTER = 1 SEC ?
NO
YES
INC CHECKING COUNTER
580
602
LITE ON FLAG ?
OFF
ON
610
PRESENT PWM, STORED PWM ?
DIMMER
LIGHTER
604
PRESENT PWM, STORED PWM ?
LIGHTER
DIMMER
TURN ON THE WORK LIGHT TOGGLE
612
TURN ON THE WORK LIGHT TOGGLE
608
CLR CHECK
606
CLEAR CHECKING
CHECK LOW
TO FIG 12D.

FROM FIG. 12E-CHECK BLANK
HAS 2.5 SEC PASSED ?
680
NO
682
TURN OFF BLANK TIMER
YES
FROM FIG. 12E - QUIET
IS THE LITE ON STATE SET ?
684
NO
MAIN LOOP
YES
HAS 6 MIN PASSED ?
686
NO
MAIN LOOP
YES
CLEAR TIMER
CLEAR LITE ON FLAG
SET BLANK FLAG
TRY TO READ LIGHT STATE SERIAL
688
SERIAL ?
690
YES SERIAL OK
NO SERIAL
692
LITE ON ?
NO
MAIN LOOP
694
SET TOGGLE OUTPUT
MAIN LOOP
700
SET TOGGLE OUTPUT
STORE PWM
702
SET CHECKING
704
MAIN LOOP

QUERY LITE
DELAY TIL KEY READING PULSE
750
RESET TIMER
752

DELAY 500 μSEC
754
OUTPUT 3A CODE
ON 1666 μSEC
OFF 833 μSEC
ON 833 μSEC
OFF 2499 μSEC
ON 1666 μSEC
756
DELAY 100 μSEC
758
IS PIN 12 WALL CONTROL INPUT LOW ?
760
NO
YES
FOR TEST HIGH ?
762
<512 μSEC
>512 μSEC
CLEAR SERIAL OK
770
SET SERIAL OK
764
TIME = 91CONT 2912
766
READ STATUS
768
SEND BREAK SIGNAL
772

MOVABLE BARRIER OPERATOR HAVING PASSIVE INFRARED DETECTOR

CROSS REFERENCE TO RELATED APPLICATION

Priority is claimed from copending U.S. application No. 60/128,209, filed Apr. 7, 1999.

BACKGROUND OF THE INVENTION

The invention relates in general to movable barrier operators and in particular to movable barrier operators such as garage door operators or gate operators which include passive infrared detectors associated with them for detecting the presence of a person or other high temperature object for controlling a function of the movable barrier operator such as illumination.

It has been known to use pyroelectric infrared detectors or passive infrared (PIR) detectors for the detection of a person in a particular vicinity. For instance, it is well known that pyroelectric infrared detectors can be used in combination with illumination lamps, carriage lamps, spot lamps and the like to form a low cost home security system. The pyroelectric infrared detector typically has a plurality of segments. One or more of the segments may be actuated by infrared radiation focused thereon by a Fresnel lens positioned in front of the PIR detector. The pyroelectric detector provides an output signal when a change occurs in the potential level between one element and another element in the array. Such an infrared detected voltage change indicates that a warm object radiating infrared radiation, typically a person, is moving with respect to the detector. The detectors to provide output signals upon receiving infrared radiation in about the ten micron wavelength range. The micron infrared radiation is generated by a body having a temperature of about 90° F., around the temperature of a human body (98.6° F.).

It is also known that garage door operators or movable barrier operators can include a passive infrared detector associated with the head unit of the garage door operator. The passive infrared detector, however, needed some type of aiming or alignment mechanism associated with it so that it could be thermally responsive to at least part of the garage interior. The detectors were connected so that upon receiving infrared energy from a moving thermal source, they would cause a light associated with the garage door operator to be illuminated.

It was known in the past to use timers associated with such systems so that if there were no further thermal signal, the light would be shut off after a predetermined period. Such units were expensive as the passive infrared detector had to be built into the head unit of the garage door operator. Also, the prior PIR detectors were fragile. During mounting of the head unit to the ceiling of the garage a collision with the aiming device associated with the passive infrared detector might damage them. The ability to aim the detection reliably was deficient, sometimes leaving blank or dead spots in the infrared coverage.

Still other operators using pivoting head infrared detectors required that the detector be retrofitted into the middle of the output circuit of a conventional garage door operator. This would have to have been done by garage door operator service personnel as it would likely involve cutting traces on a printed circuit board or the like. Unauthorized alteration of the circuit board by a consumer might entail loss of warranty coverage of the garage door operator or even cause safety problems.

What is needed then is a passive infrared detector for controlling illumination from a garage door operator which could be quickly and easily retrofitted to existing garage door operators with a minimum of trouble and without voiding the warranty.

SUMMARY OF THE INVENTION

A passive infrared detector for a garage door operator includes a passive infrared detector section connected to a comparator for generating a signal when a moving thermal or infrared source signal is detected by the passive infrared detector. The signal is fed to a microcontroller. Both the infrared detector and the comparator and the microcontroller are contained in a wall control unit. The wall control unit has a plurality of switches which would normally be used to control the functioning of the garage door operator and are connected in conventional fashion thereto.

The PIR detector is included with the switches for opening the garage door, closing the garage door and causing a lamp to be illuminated. The microcontroller also is connected to an illumination detection circuit, which might typically comprise a cadmium sulphide (CdS) element which is responsive to visible light. The CdS element supplies an illumination signal to an ambient light comparator which in turn supplies an illuminator level signal to the microcontroller. The microcontroller also controls a setpoint signal fed to the comparator. The setpoint signal may be adjusted by the microcontroller according to the desired trip point for the ambient illumination level.

The microcontroller also communicates over the lines carrying the normal wall control switch signals with a microcontroller in a head unit of the garage door operator. The wall control microcontroller can interrogate the garage door operator head unit with a request for information. If the garage door operator head unit is a conventional unit, no reply will come back and the wall control microcontroller will assume that a conventional garage door operator head is being employed. In the event that a signal comes back in the form of a data frame which includes a flag that is related to whether the light has been commanded to turn on, the microcontroller can then respond and determine in regard to the status of the infrared detector and the ambient light whether the light should stay on or be turned off.

In the event that a conventional garage door operator head is used, the microcontroller can, in effect, create a feedback loop with the head unit by sending a light toggling signal to the microcontroller in the head unit commanding it to change the light state. If the light turns on, the increase in illumination is detected by the cadmium sulphide sensor and so signaled to the microcontroller head allowing the light to stay on. If, in the alternative, the light is turned off and the drop in light output is detected by the cadmium sulphide detector, the wall control microcontroller then retoggles the light, switching it back on to cause the light to stay on for a full time period allotted to it, usually two-and-one-half to four-and-one-half minutes.

It is a principal aspect of the present invention to provide a quickly and easily retrofitted passive infrared detector for controlling the illumination of a garage door operator through conventional signaling channels.

It is another aspect of the instant invention to provide a garage door operator having a passive infrared detector which passive_infrared detector_can control a variety of garage door operators.

Other aspects and advantages of the present invention will become obvious to one of ordinary skill in the art upon a perusal of the following specification and claims in light of the accompanying drawings.

BRIEF DESCRIPTION OF THE DRAWINGS

FIGS. 12A–H are flow charts showing details of a program flow controlling the operation of a microcontroller contained within the wall control as shown in FIGS. 3A–C.

DETAILED DESCRIPTION OF THE PREFERRED EMBODIMENT

Figure 1:
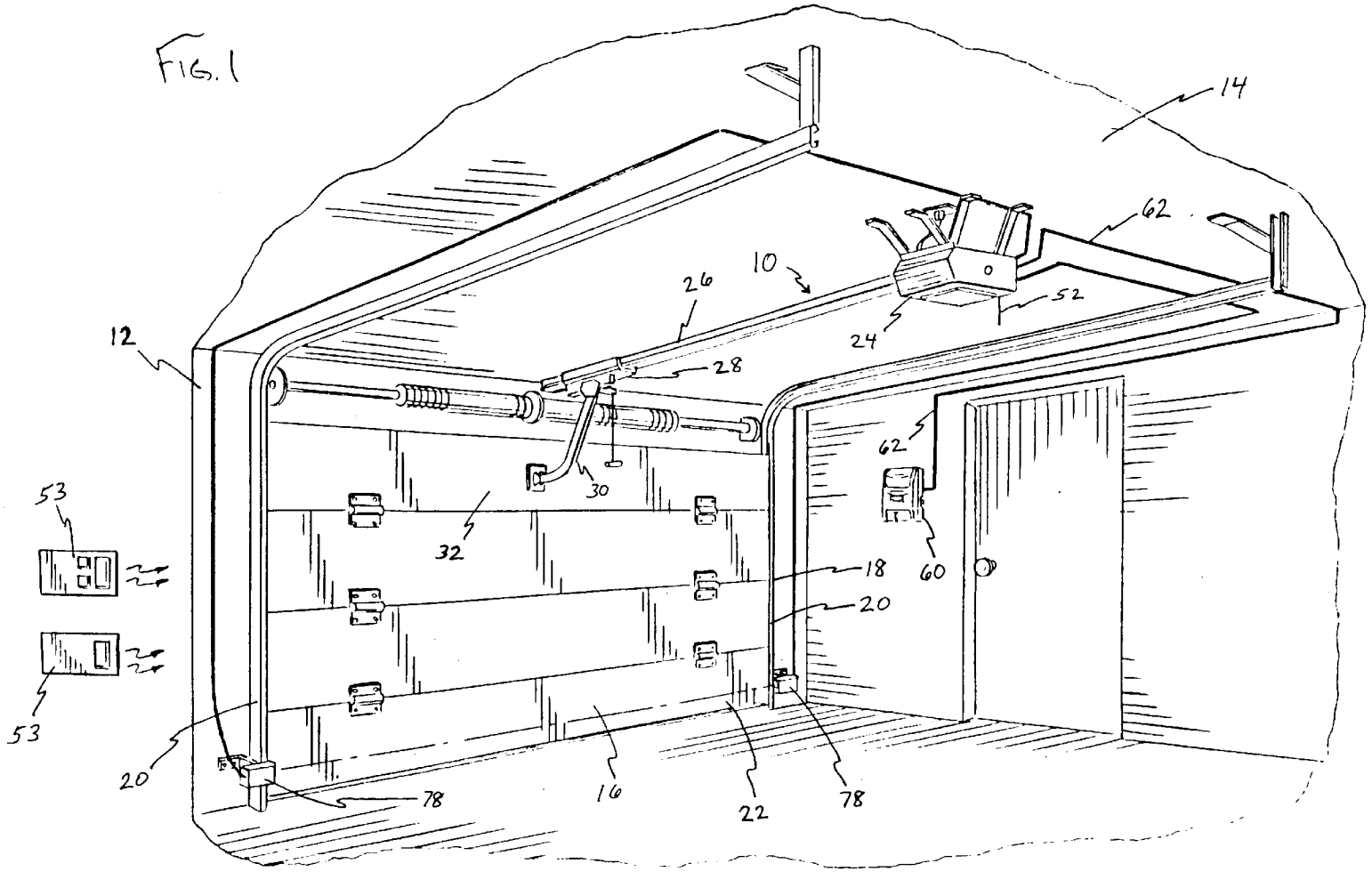
FIG. 1 is a perspective view of a garage including a movable barrier operator, specifically a garage door operator, having associated with it a passive infrared detector in a wall control unit and embodying the present invention.

Referring now to drawings and especially to FIG. 1, a movable barrier operator embodying the present invention is shown therein and generally identified by reference numeral 10. The movable barrier operator, in this embodiment a garage_door operator 10, is positioned within a garage 12. More specifically, it is mounted to a ceiling 14 of the garage 12 for operation, in this embodiment, of a multipanel garage door 16. The multipanel garage door 16 includes a plurality of rollers 18 rotatably confined within a pair of tracks 20 positioned adjacent to and on opposite sides of an opening 22 for the garage door 16.

The garage door operator 10 also includes a head unit 24 for providing motion to the garage door 16 via a rail assembly 26. The rail assembly 26 includes a trolley 28 for releasable connection of the head unit 24 to the garage door 16 via an arm 30. The arm 30 is connected to an upper portion 32 of the garage door 16 for opening and closing it. The trolley 28 is connected to an endless chain to be driven thereby. The chain is driven by a sprocket in the head unit 24. The sprocket acts as a power takeoff for an electric motor located in the head unit 24.

Figure 2:
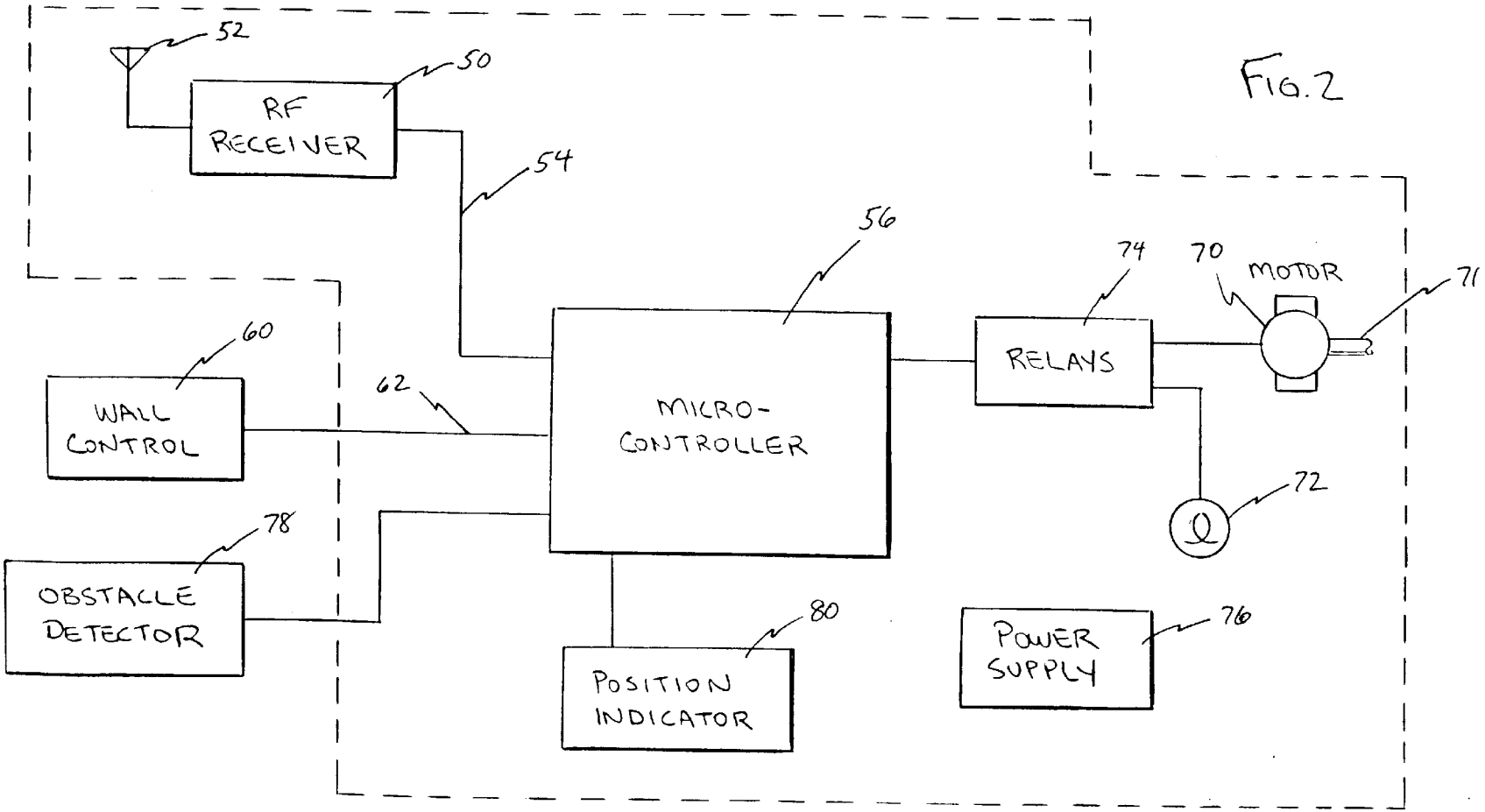
FIG. 2 is a block diagram showing the relationship between major electrical systems of a portion of the garage door operator shown in FIG. 1.

The head unit 24 includes a radio frequency receiver 50, as may best be seen in FIG. 2, having an antenna 52 associated with it for receiving coded radio frequency transmissions from one or more radio transmitters 53 which may include portable or keyfob transmitters or keypad transmitters. The radio receiver 50 is connected via a line 54 to a microcontroller 56 which interprets signals from the radio receiver 50 as code commands to control other portions of the garage door operator 10.

Figure 3A:
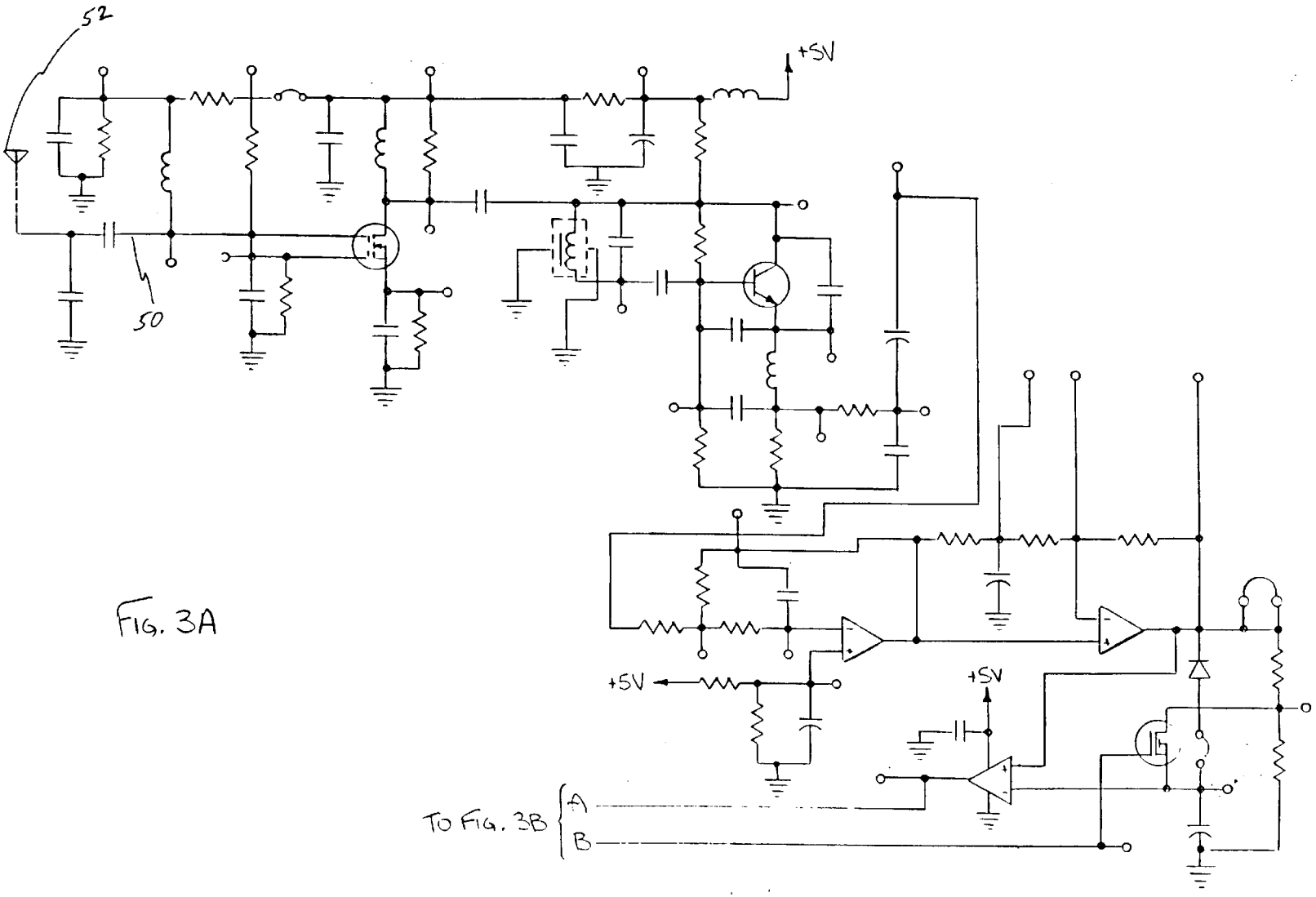
FIGS. 3A–C are schematic diagrams of a portion of the electrical system shown in FIG. 2.
Figure 3B:
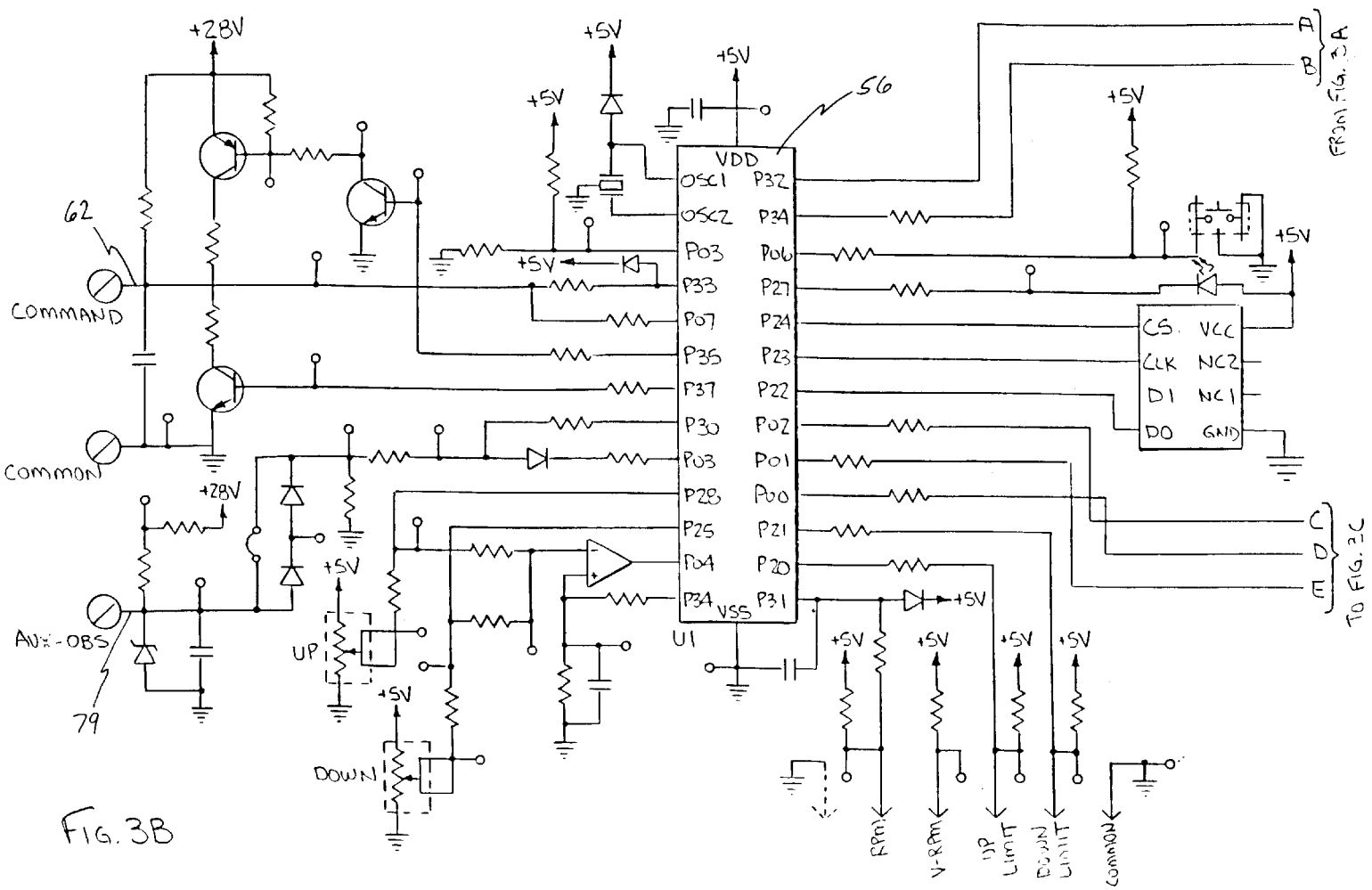
Figure 3C:
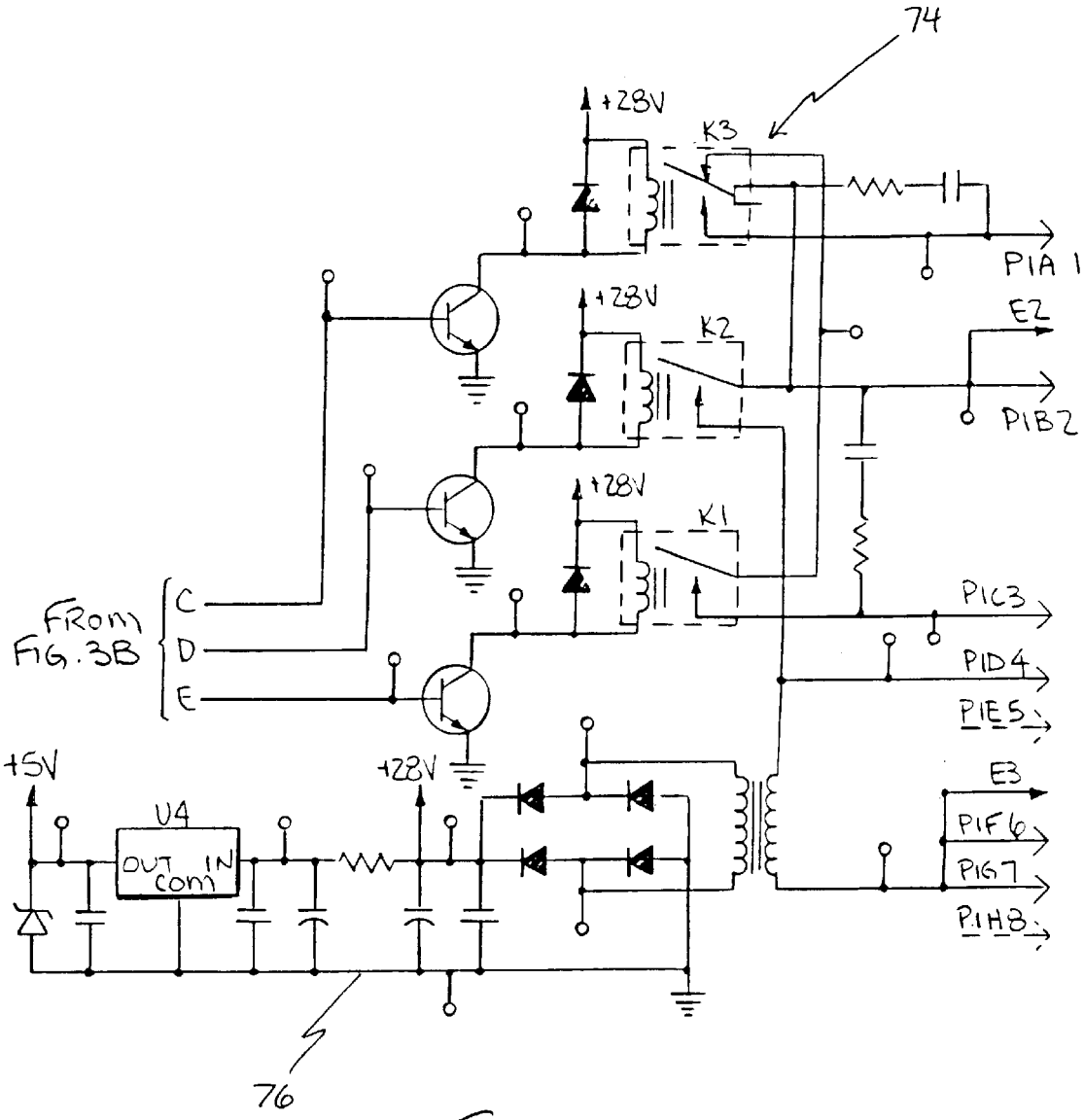

A wall control unit 60 embodying the present invention, as will be seen in more detail hereafter, communicates over a line 62 with the head unit microcontroller 56 to effect control of a garage door operator motor 70 and a light 72 via relay logic 74 connected to the microcontroller 56. The entire head unit 24 is powered from a power supply 76. In addition, the garage door operator 10 includes an obstacle detector 78 which optically or via an infrared pulsed beam detects when the garage door opening 22 is blocked and signals the microcontroller 56 of the blockage. The microcontroller 56 then causes a reversal or opening of the door 16. In addition, a position indicator 80 indicates to the head unit microcontroller 56, through at least part of the travel of the door 16, the door position so that the microcontroller 56 can control the close position and the open position of the door 16 accurately. FIGS. 3A–C are schematic diagrams of a portion of the electrical system shown in FIG. 2.

Figure 4:
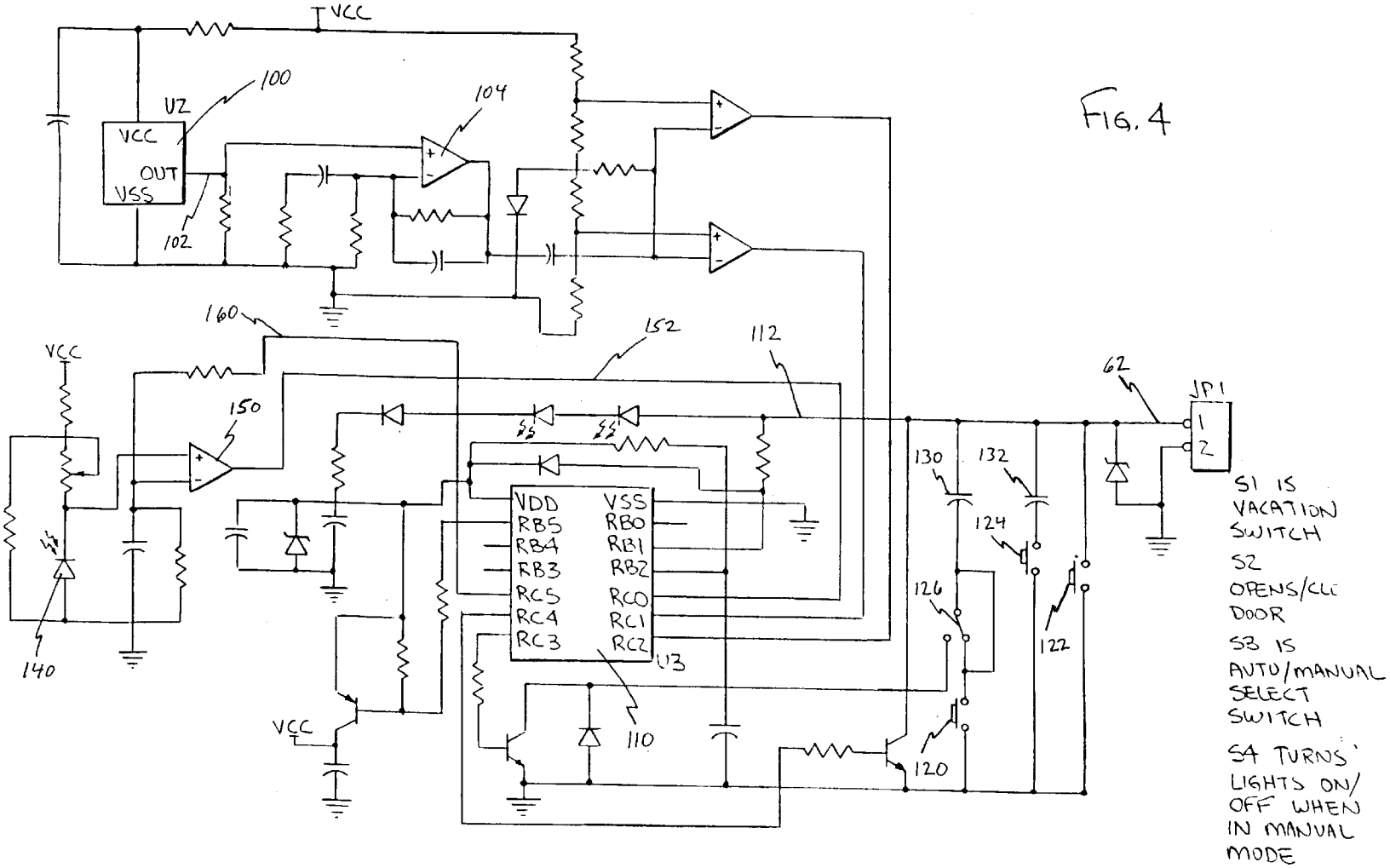
FIG. 4 is a schematic diagram of the wall control including the passive infrared detector.
Figure 5:
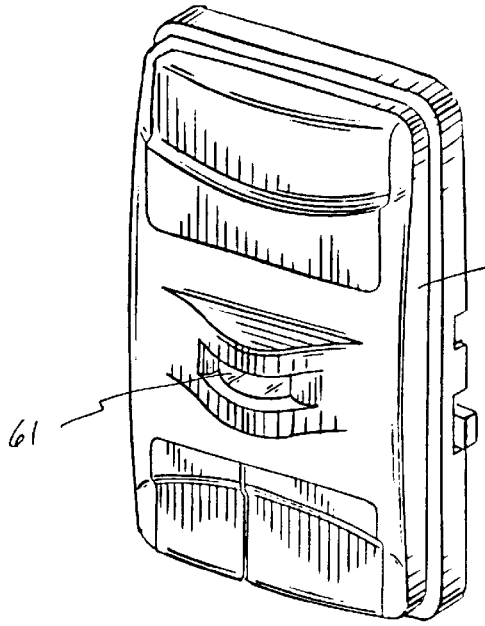
FIG. 5 is a perspective view of the wall control.
Figure 6:
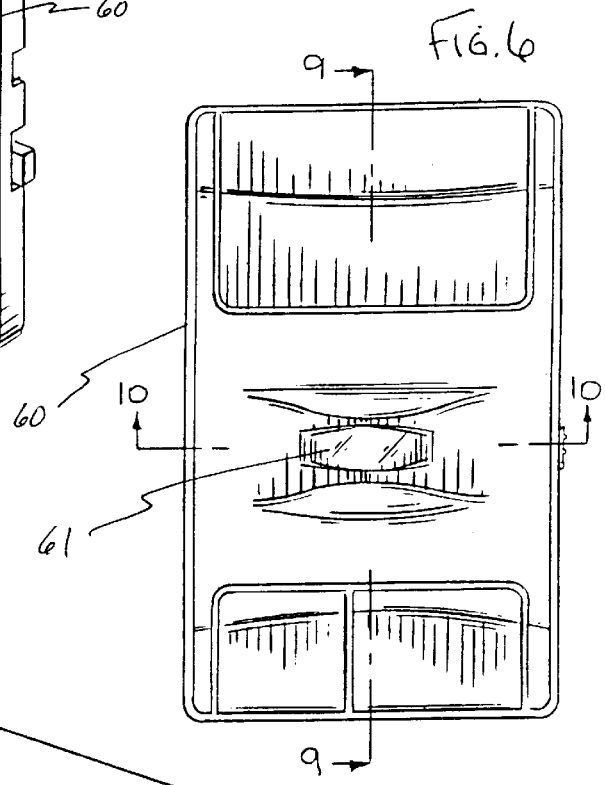
FIG. 6 is a front elevational view of the wall control shown in FIG. 6.
Figure 11:
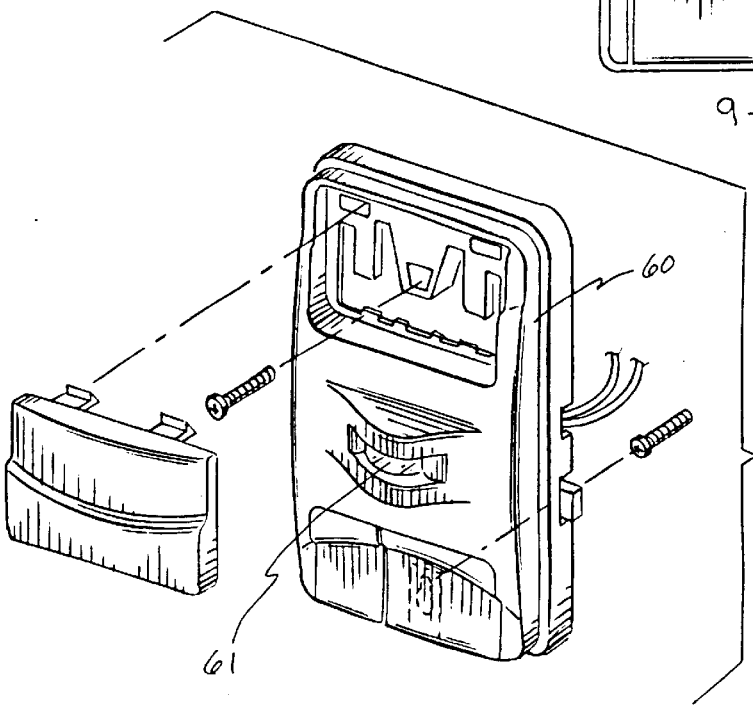
FIG. 11 is a partially exploded perspective view of the wall control shown in FIG. 5.
Figure 7:
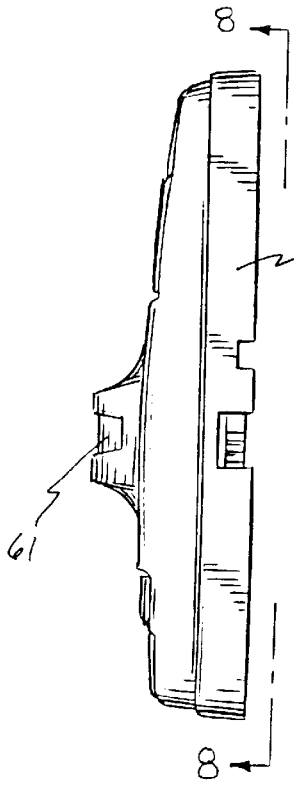
FIG. 7 is a side view of the wall control shown in FIG. 6.
Figure 8:
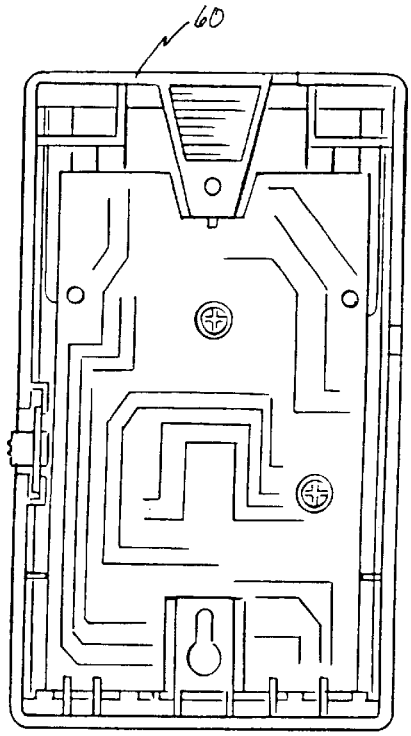
FIG. 8 is a rear elevational view of the wall control shown in FIG. 6.
Figure 9:
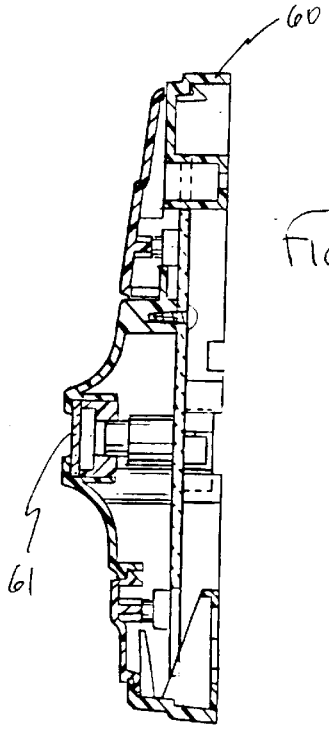
FIG. 9 is a side view, shown in cross section, of the wall control in FIG. 7.
Figure 10:
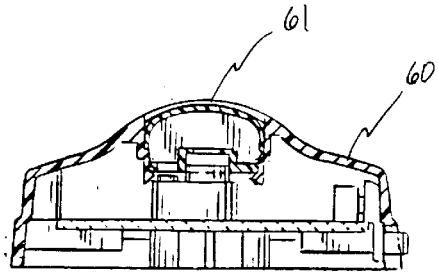
FIG. 10 is a plan view, shown in cross section, of the wall control.

The wall control 60, as may best be seen in FIG. 4, includes a passive infrared sensor 100 having an output line 102 connected to a differential amplifier 104. The differential amplifier 104 feeds a pair of comparators 106 and 108 coupled to a wall control microcontroller 110, in this embodiment a Microchip PIC 16505. The sensor 100 changing signals from the comparators when the infrared illumination changes at the passive infrared sensor 100. The microcontroller 110 provides an output at line 112 to the line 62, which is connected to the microcontroller in the GDO head. Also associated with the wall control is a momentary contact light switch 120, a door control switch 122, a vacation switch 124, and an auto-manual select switch 126. The light switch 120 is connected through a capacitor 130 to other portions of the wall control 60. The vacation switch 124 is connected through a capacitor 132 to the wall control 60. The capacitor 132 has a different value than the capacitor 130. The wall control 60 controls the microcontroller 56 through its switches by the effective pulse width or charging time required when a respective switch closes as governed by its associated capacitor or by the direct connection, as is set forth for the door control switch 122.

In addition, an ambient light sensor 140 is provided connected in a voltage divider circuit having a variable resistance 134 which feeds a comparator 150 which supplies an ambient light level signal over a line 152 to the microcontroller 110.

In addition, the microcontroller 110 supplies a setpoint signal on a line 160 back to the comparator 150 so that the microcontroller 110, through the use of pulse width modulation, can control the setpoint of the light level comparator 150 to determine the point where the ambient light comparator 150 trips and thereby determine the ambient light illumination level. FIGS. 5–11 are various views of the wall control 60 discussed above. FIGS. 12A–H are flow charts showing details of a program flow controlling the apparatus of microcontroller 56 contained within the wall control 60 as shown in FIGS. 3A–C.

As may best be seen in FIG. 12 when the processor or microcontroller 110 powers up ports and outputs are set as well as the timer in a step 500 at which point a main loop is entered and the timer is read in a step 502. A test is made to determine if 10 milliseconds have elapsed in step 504 if they have not, control is transferred back to step 502. If they have, the pulse width modulation cycle is cleared in a step 506 in order to start the pulse width modulation to govern the setpoint for the illumination. In step 508, the pulse width modulation output is turned on and the pulse width modulation counter is cleared. In step 510, the pulse width modulation counter is incremented and a test is made to determine whether the pulse width modulation counter is equal to the pulse width modulation value in a step 512. If it is not, control is transferred to step 510. If it is, control is transferred to a step 514 where the pulse width modulator has the counter cleared and is turned off and the pulse width modulation value is output. Followed by a step 516 where the pulse width modulation counter is incremented and a test is made to determine whether the value of the pulse width modulation counter is equal to pwm rem in a step 518. If it is not, control is transferred back to step 516.

If it is, as may best be seen in FIG. 12B, the pulse width modulation cycle is incremented in a step 520, and a test is made in step 522 to determine whether it is equal to six. If it is not, control is transferred back to step 508 to restart the pulse width modulation. If it is, the pulse width modulator is turned off in step 526 and a read comparison is made in a step 530. If the read comparator is high, the plunge counter is decremented in a step 532, and the increment counter is incremented in a step 534. In a step 536, the value of the incremented counter is tested to determine whether it is greater than 10. If it is, the counter is cleared and a step 538. If it is not, control is transferred to a step 540 where the pulse width remainder value is set equal to pulse width modulation value compliment.

In the event that the value of the read comparison step 530 yields a low value, a leap counter is cleared in a step 550 and a decrement counter is incremented in a step 552. A test is made in a step 554 to determine whether the decrement counter value is greater than 10. If it is not, control is passed to step 540. If it is, the decrement counter is cleared in a step 556 and a test is made to determine whether the pulse width modulation value is zero in a step 560. If it is zero, control is transferred to step 540. If it is not, the pulse width modulation value is decremented, the plunge counter is incremented in a step 562. In a step 564, the plunge counter is tested to determine whether it is greater than 12. If it is, the pulse width modulation value is tested for whether it is less than 20 in a step 566. If it is not, the pulse width modulation value is set equal to the pulse width modulation value minus nine in a step 568 and control is transferred to the step 540.

Figure 12A:
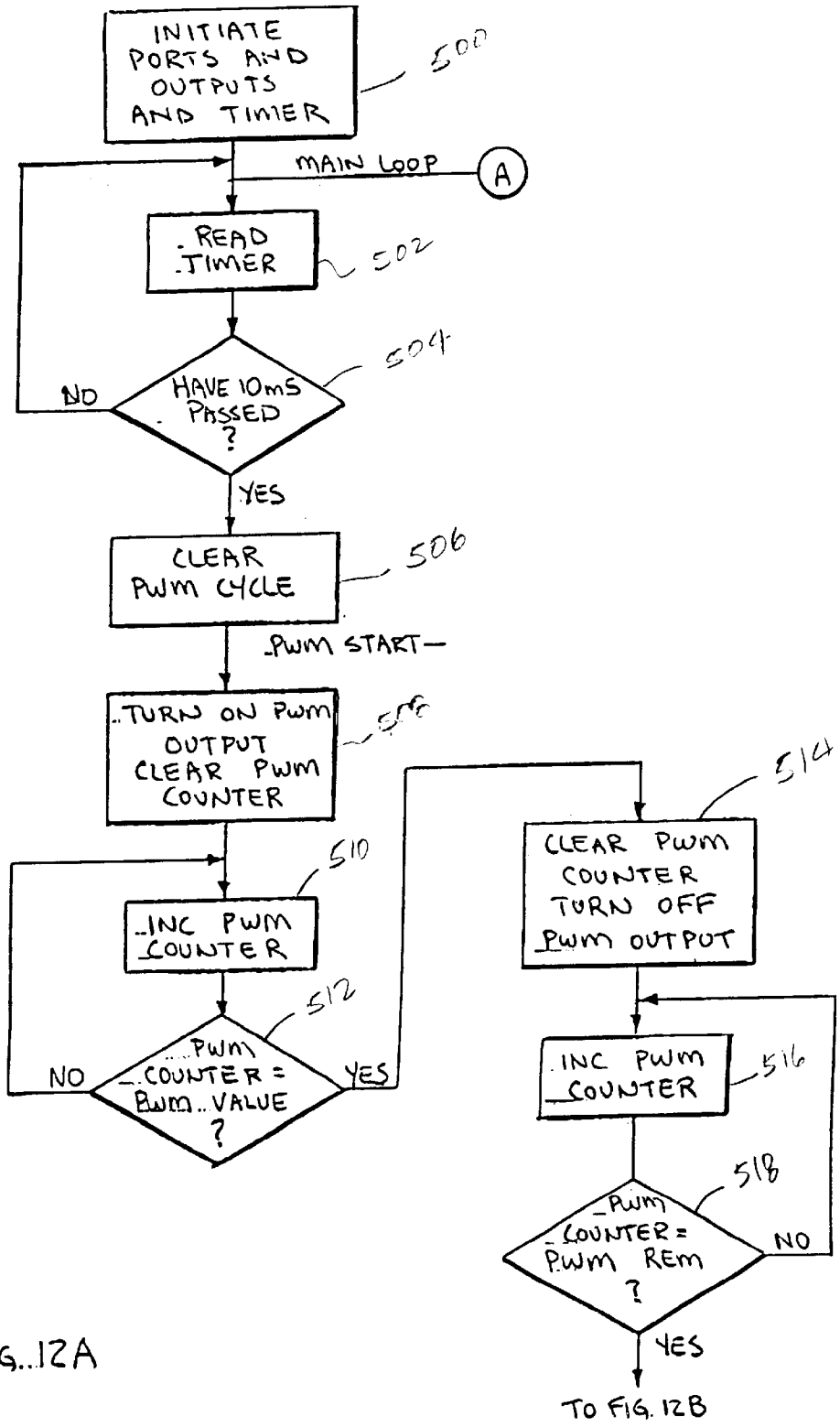
Figure 12D:
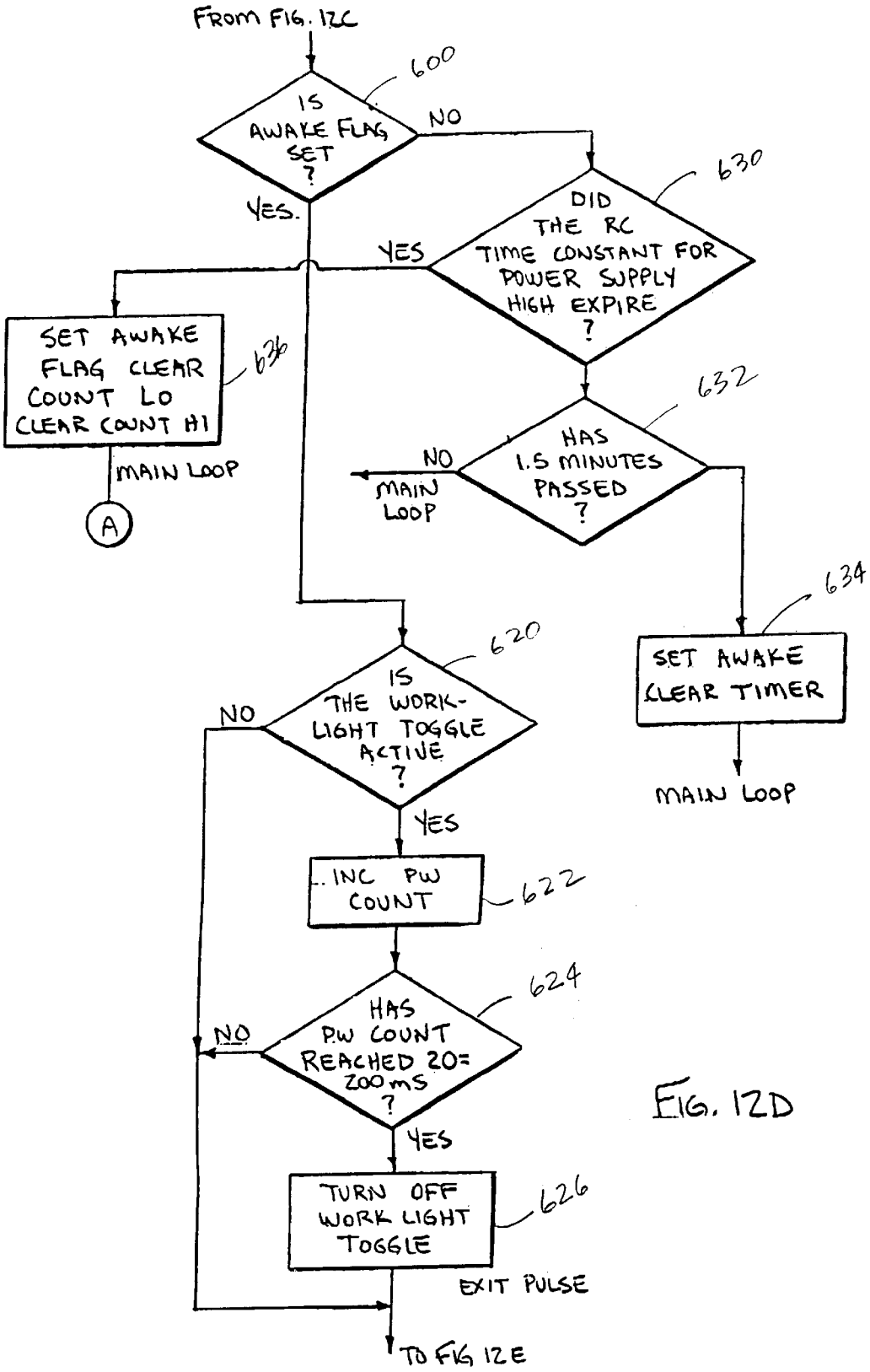
Figure 12E:
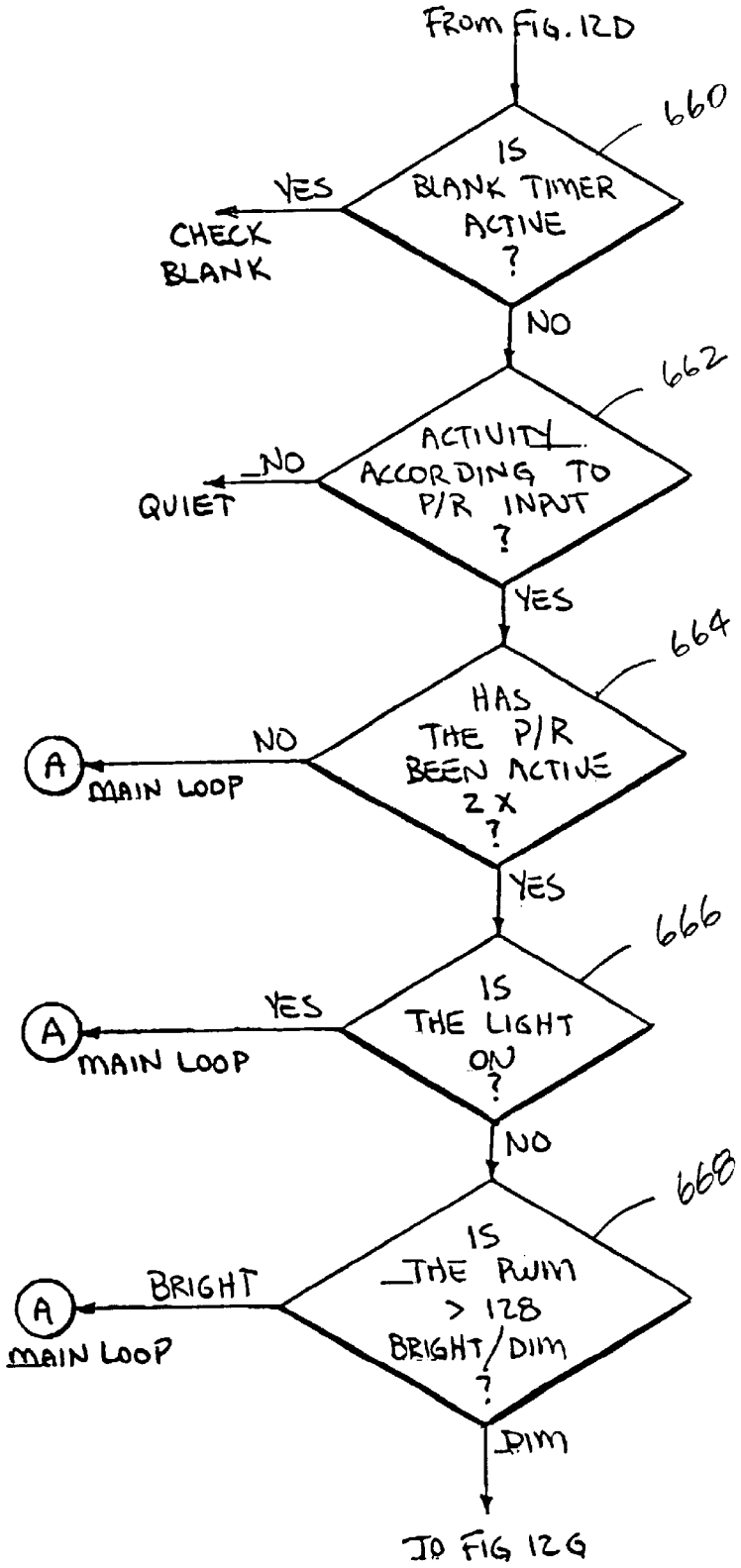

Upon exiting the step 540, as may best be seen in FIG. 12C, a test step 570 is entered to determine whether the light on state has been set by the head unit of the movable barrier operator. If it is not, a test is made in a step 522 to determine whether the awake timer is active. If the awake timer is active, control is transferred to a step 574 causing a 16-bit counter timer to be incremented and to blank any bit counter. If the timer is not active, control is transferred to determine whether the blank timer is active in a step 576. If it is, control is transferred to step 574. If it is not, control is transferred to a test step 578 to determine whether checking is active. If checking is active, the checking counter is incremented in the step 530 and a test is made to determine whether the value of the checking counter is equal to one second in a step 582. If it is not, control is transferred to a test step 600, as shown in FIG. 12D. If it is, a test is made to determine whether the light-on flag is on or not in a step 602. If it is on, a test is made in a step 604 to determine whether the present pulse width modulation value is equal to the stored modulation value. If it is indicated to be lighter, control is transferred to a step 606 to clear checking. If it is indicated to be dimmer, control is transferred to a step 608 causing the work light signal to e toggled by the wall control over the lines connected to the head unit. If the light-on value flag is indicated to be off, a test is made in a step 610 to determine whether the present pulse width modulation value is equal to the stored value. If it's indicated to be dimmer, control is transferred to the step 606. If it's indicated to be lighter, step 612 turns on the work light toggle to flip the light state and transfers control to step 606.

Once the light has been toggled, a test is made in step 600, as shown in FIG. 12D, to determine whether the awake flag has been set. If it has, a test is made in a step 620 to determine whether the work light toggle is active. If it is, the pulse width value is incremented in a step 622, and a test is made to determine whether the pulse width count is equal to 20 (which is equivalent to 200 milliseconds) in a step 624. If it is not, the work light is toggled off in a step 626. In the event that the awake flag has not been set, a test is made in a step 630 to determine whether the RC time constant for the power supply has expired. In other words, has the power been kept high for more than 1.5 minutes as tested for in step 630. If it has not, control is transferred back to the main loop in FIG. 12A. If it is, the awake value is set and the timer is cleared in the step 634, and control is transferred back to the main loop. In the event that the time constant has expired in step 630, the awake flag is cleared and the counts are set high in the step 636 after which control is transferred back to the main loop. After the work light has been toggled and the step 626, a step is made in a step 660, as may best be seen in FIG. 12E to determine if the blank timer is active. If it is, it is checked. If it is not, a test is made to determine whether there is indicated to be activity from the passive infrared input indicating a change in a step 662. If not, a quiet state is entered. If the PIR has been indicated to be active, a second test is made to determine whether the PIR still indicates that it is changing to indicate that a false signal has not been received. If it is, a test is made to determine whether the work light is on within the garage. If the work light is on, control is transferred back to the main loop. If the work light is indicated not to be on, a test is made to determine whether the pulse width value is greater than 128, in other words, whether the garage is indicated to be bright or dim. If it is indicated to be bright, indicating it's illuminated control is transferred back to the main loop. If it's indicated to be dim, control is transferred to the test step 680, as may best be seen in FIG. 12G to determine whether two-and-one-half seconds had elapsed. If they have not, the blank timer is turned off in the step 682. If they have, a test is made in the step 684 to determine whether the light-on state has been set. If it has, a test is made in a step 686 to determine whether six minutes have passed. If they have, the timer is cleared, the light-on flag is cleared, the blank flag is set, and an attempt is made to read the light state from the head unit via serial communication in a step 688. A test is made in a step 690 to determine whether the serial communication has been successful. If it has, a test is then made in a step 692 to determine whether the light-on flag has been returned from the head unit to the wall control. If it has, indicating the light has been set on, the toggle output is set in a step 694. If it has not, control has been transferred to the main loop. If serial communication has failed, as tested for in step 690, the toggle output is set in a step 700, pulse width modulated value is stored in a step 702, and checking is set in a step 704 prior to transfer back to the main loop.

Figure 12F:
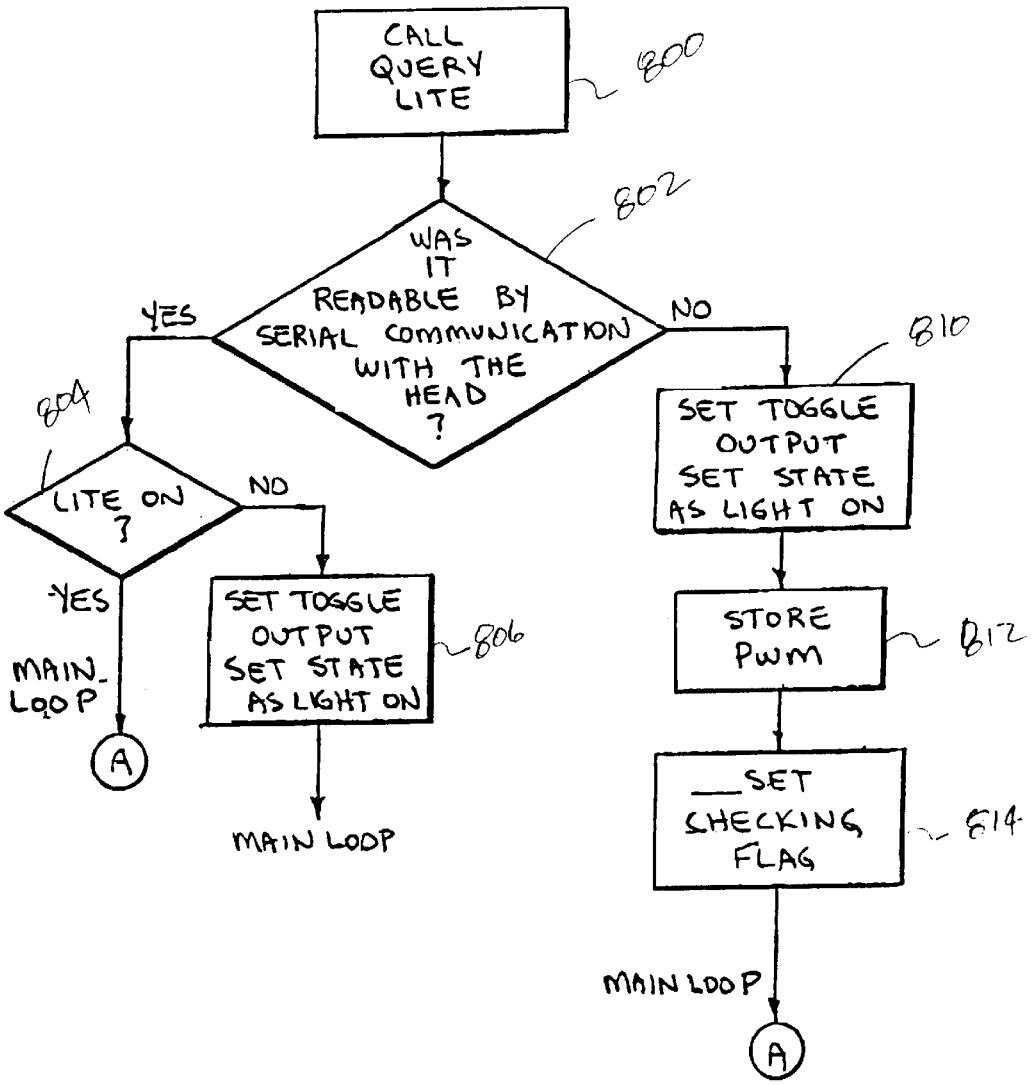
Figure 12G:
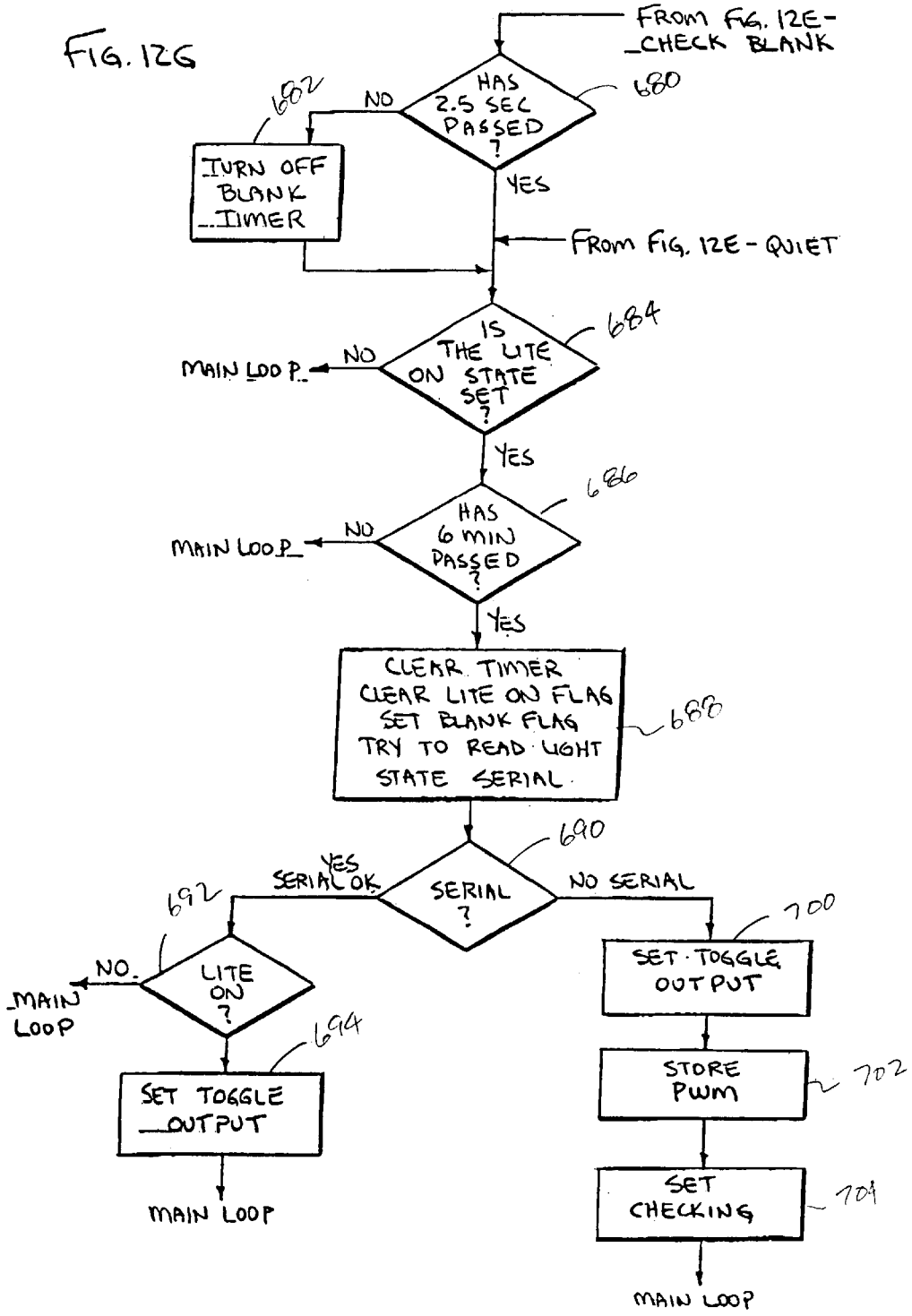
Figure 12H:
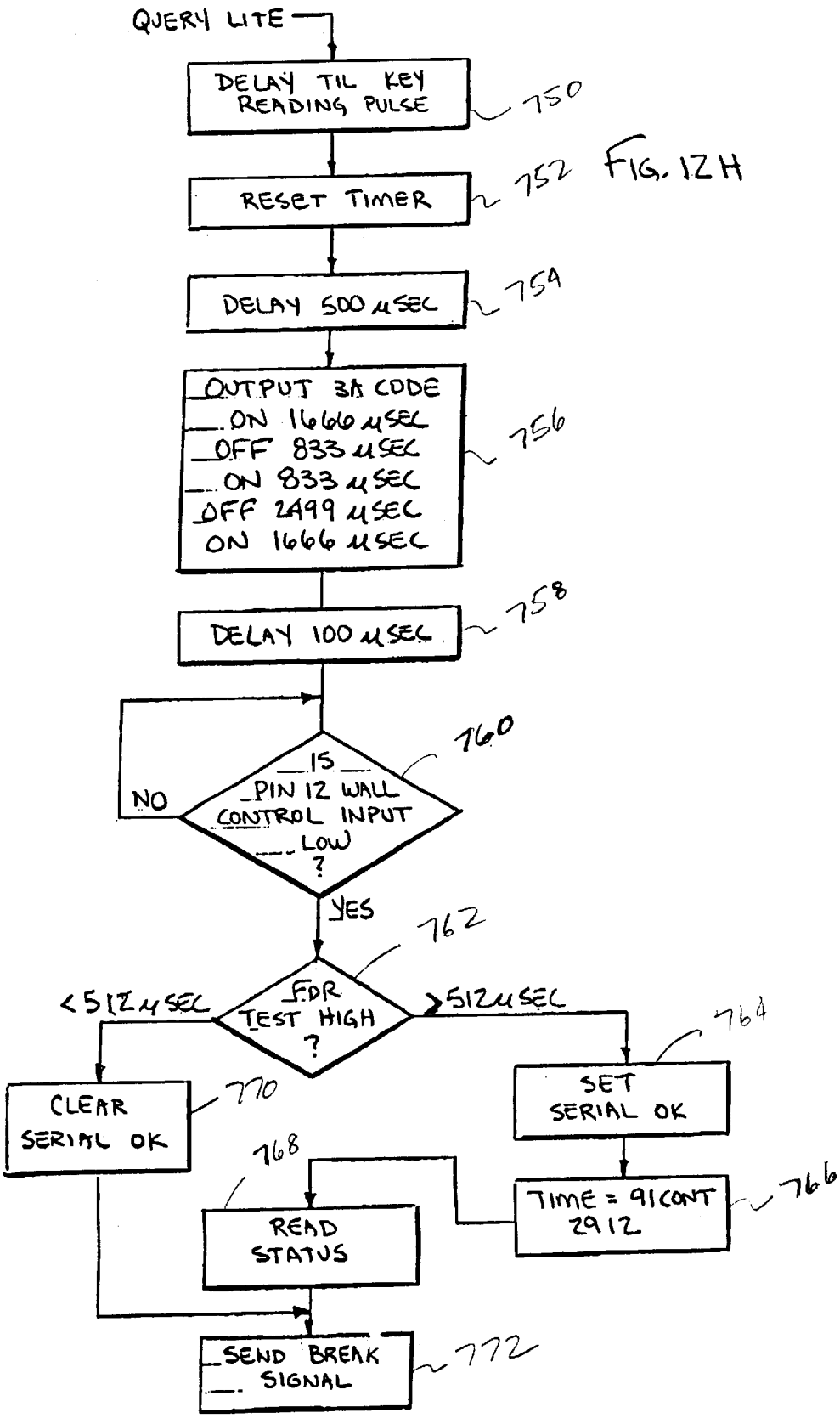

In order to respond to the query function, which is used to interpret the word sent back by the head unit, as may best be seen in FIG. 12H. In a step 750, there is a delay until a key reading pulse in a step 752 and a timer is reset in a step 754. A 500 microsecond delay is waited for in a step 756. A series of delays are used to generate an on-off output code of varying pulse widths followed by a 100 microsecond delay in a step 758. A test is then made in a step 760 to determine whether the wall control input pin is low. If it is not, the test is remade. If it is, control is transferred to a step 762 to set a flag indicating serial communication is successful. A time value is set is a step 766 and status is read in a step 768. A test is made in step 770 to determine whether the serial is okay and in a test 772 a brake signal is tested for and sent.

In order to respond to the query light, as is shown in FIG. 12F, in a step 800 the query light is called. A test is made in a step 802 to determine whether it was readable by a serial communication with the head. If it was, a test is made in a step 804 to determine whether the light was on. If it was, control is transferred back to the main loop. If it was not, the toggle output is set to indicate that the state was light-on in step 806 to force the light to be on.

In the event that the serial communication was not readable, the toggle output state was set, it's light on in step 810, pulse width modulation value restored in the step 812, and the checking flag is set in the step 814. Attached is an Appendix consisting of pages A-1 to A-12 which comprises a listing of the software executing on the microcontroller 110.

While there has been illustrated and described a particular embodiment of the present invention, it will be appreciated that numerous changes and modifications will occur to those skilled in the art, and it is intended in the appended claims to cover all those changes and modifications which fall within the true spirit and scope of the present invention.

```
    list          p=16c505        ; list directive to define processor
    #include    <p16c505.inc>     ; processor specific variable definitions
    __CONFIG   __CP__ON & __WDT__OFF & __MCLRE__OFF & __IntRC__OSC__CLKOUTEN
; '__CONFIG' directive is used to embed configuration word within .asm file.
; The lables following the directive are located in the respective .inc file.
; See respective data sheet for additional information on configuration word.
;***** VARIABLE DEFINITIONS
PWCount          EQU    0x08   ; counter used for output pulse width
                        ; must count to 20 (200ms)
CountLo          EQU   0x09     ; low byte of 5 minute counter (255=2.55 seconds)
CountHi          EQU   0x0a     ; high byte of 5 minute counter (118=5
minutes)
State       EQU  0x0b   ; bit0 high if light has been turned on
                        ; bit1 high if past initial blanking period (10 seconds)
                        ; bit2 high to prevent retriggering from shutoff pulse
                        ; bit3 high to indicate checking in progress
                        ; bit4 high to indicate RS232OK
                        ; bit5 high to indicate WORKLIGHT on
#define             LITEON        0     ;
#define             AWAKE 1       ;
#define             BLANK 2       ;
#define             CHECKING 3    ;
BlankCnt    EQU  0x0c   ; used to prevent triggering from shutoff pulse
PresCnt          EQU   0x0d   ; used to count presence of signal, 10ms/count
PWMCount    EQU  0x0e   ; used as main counter for pwm functions
PWMVal           EQU   0x0f   ; high duration count (0 - 255)
PWMRem           EQU   0x10   ; low duration count (0 - 255)
PWMCycle    EQU  0x11   ; counts cycles, need 8 to run 10ms
IncCount    EQU  0x12   ; counts high readings before incrementing pwm
DecCount    EQU  0x13   ; counts low readings before decrementing pwm
StoredPWM   EQU  0x14   ; stored value of PWM, used to check if light has
increased or decreased
CheckCnt    EQU  0x15   ; counter used to count one second before checking light
value
LoCnt       EQU  0x16   ; counter used to measure low pulse width on line
WarmBoot    EQU  0x17   ; set to 0x55 in normal ops. Check if==0x55 on powerup,
cold boot if not
LeapCount   EQU  0x18   ;
PlungeCount EQU  0x19   ;
;       RC0 - photocell input, high for Dark
;       RC1 - PIR input 1, low for disturbance
;       RC2 - PIR input 2, high for disturbance
;       RC3 - Pulse output, 250ms high pulse to drive transistor
;       RB2 - Test input - when low, startup timer is eliminated, and the light is
held on
;             for 3 seconds instead of 5 minutes.
#define          DARK        0
#define          PIRH        1    ; active high, pin 9
#define          PIRL        2    ; active low, pin 8
#define          PULSEOUT    3    ; transistor drive outpnt
#define          PWMOUT           5     ; test output on RC5
```

-continued

```
#define          RS232DRV     4    ; test output on RC4
#define          TESTP13           0     ; test output on RB0
#define          WORKLIGHT    5    ; bit 5 of State byte, high to indicate that
worklight is on (based on query)
#define          RS232OK           4     ; bit 4 of State byte, indicates that
RS232 is supported by GDO
;*****************************************************************************
          ORG   0x3FF              ; processor reset vector
; Internal RC calibration value is placed at location 0x3FF by Microchip
; as a movlw k, where the k is a literal value.
        ORG     0x000            ; coding begins here
        movwf   OSCCAL           ; update register with factory cal value
        clrf    FSR              ; ensure FSR register points to Bank0
; Setup option register for prescaling, timer uses internal clock and prescaler
;     movlw   0x0              ; temporary patchout to speed sim, @@@
      movlw   0x044            ; set prescaler to divide by 32, disable pullups
                               ; timer period is 32us
      option                        ;
; Setup ports
;     RC0 - photocell input, high for Dark
;     RC1 - PIR input 1, high for disturbance
;     RC2 - PIR input 2, low for disturbance
;     RC3 - Pulse output, 250ms high pulse to drive transistor
;     RB2 - Test input - when low, startup timer is eliminated, and the light is
held on
;             for 3 seconds instead of 5 minutes.
      movlw   0x07             ; set RC3,4,5 only as output
      tris    PORTC            ;
      movlw   0x6              ; set RBX as outputs, except for RB2 and RB1
      tris    PORTB            ;
      bcf     PORTB,5                  ; turn on power to amplifier
      bsf     State.BLANK      ; set BLANK so that vacation mode won't cause retriggers
      clrf    BlankCnt         ;
      movlw   0x55
      subwf   WarmBoot,w       ; if WarmBoot==0x55, assume warm boot and go to main
loop
      btfsc   STATUS,Z         ;
      goto    main_loop        ;
      bcf     PORTB,TESTP13            ;
      clrf    TMR0             ; start timer off at zero
      bcf     PORTC,RS232DRV           ;
      clrf    PWCount                  ; initialize all variables
      clrf    CountLo                  ;
      clrf    CountHi                  ;
      clrf    State            ;
      clrf    PORTC            ;
      clrf    PORTB            ;
      clrf    PresCnt                  ;
      bcf     State,BLANK      ;
      bcf     State,CHECKING           ;
      clrf    CheckCnt         ;
      clrf    IncCount         ;
      clrf    DecCount         ;
      clrf    LoCnt            ;
      movlw   0x7f
      movwf   PWMVal                   ; temporary values for sim
      movwf   PWMRem                   ;
      clrf    PlungeCount      ;
      clrf    LeapCount        ;
main_loop
; turn on PWM output
      clrf    PWMCycle         ;
      movlw   0x07             ; set RC3,4,5 only as output
      tris    PORTC            ;
; set pwm output high
PWMStart:
      bsf     PORTC,PWMOUT             ;
      clrf    PWMCount         ;
; count PWMVal counts
PWM1:
      incf    PWMCount,1       ;
      movf    PWMVal,0         ; put PWMVal into w
      subwf   PWMCount,0       ; w= PWMCount – PWMVal (if result is positive or zero, C
is set)
      btfss   STATUS,C         ; if C is clear, stay in the loop
      goto    PWM1             ;
      clrf    PWMCount         ;
```

-continued

```
; clear PWM output
    bcf     PORTC,PWMOUT        ;
; count PWMRem counts
PWM2:
    incf    PWMCount,1      ;
    movf    PWMRem,0        ; put PWMRem into w
    subwf   PWMCount,0      ; w = PWMCount – PWMRem
    btfss   STATUS,C        ; if C is clear (PWMRem>PWMCount), stay in loop
    goto    PWM2            ;
; this point is hit about every 1.6ms
; check if line is low for three consecutive cycles - if so, go to sleep - if
not, clear counter
    btfsc   PORTB,1                 ;
    goto    linehi                  ;
    incf    LoCnt,1                 ;
    movlw   3               ;
    subwf   LoCnt,0                 ;
    btfss   STATUS,Z        ;
    goto    chkcycles       ;
    bsf     PORTB,5                 ; turn off analog section
    movlw   0x55            ;
    movwf   WarmBoot        ;
    sleep                           ; exit from sleep will be through reset
linehi:
    clrf    LoCnt           ;
; check if PWM program has run 6 times - if not, run it again
chkcycles:
    incf    PWMCycle,1      ;
    movlw   0x6             ;
    subwf   PWMCycle,0      ;
    btfss   STATUS,C        ;
    goto    PWMStart        ;
; if so, turn off PWM output and go to processing functions
    movlw   0x27            ; set RC3,4,5 only as output
    tris    PORTC           ;
; check comparator - if low, reduce output voltage
    btfsc   PORTC,0                 ;
    goto    boostpwm        ; if light comparator is high, go to boost output
voltage
    clrf    LeapCount       ;
    incf    DecCount,1      ;
    movlw   0xa             ;
    subwf   DecCount,0      ; check if DecCount is >10
    btfss   STATUS,C        ; if not, get out of ad ops
    goto    ad_done                 ;
    clrf    DecCount        ; if it is >10, clear DecCount
    movf    PWMVal,1        ; check if PWMVal is 0 - if not, decrement it
    btfsc   STATUS,Z        ;
    goto    ad_done                 ;
    decf    PWMVal,1        ; decrement PWMVal, put back in PWMVal
    incf    PlungeCount,1           ; increment PlungeCount
    movlw   0xc             ;
    subwf   PlungeCount,w           ; check if PlungeCount>12 -> w=PlungeCount–12 ->
if PlCnt<12, C=0
    btfss   STATUS,C        ; if not, get out of ad ops
    goto    ad_done                 ;
    movlw   0x20            ; if PWMVal < 0x20, don't sub 10
    subwf   PWMVal,w        ; w=PWMVal–20. if PWMVal<20, C=0, and get out.
    btfss   STATUS,C        ;
    goto    ad_done                 ;
    movlw   0x9             ;
    subwf   PWMVal,f        ; PWMVal = PWMVal – 9
    goto    ad_done
boostpwm:
    clrf    PlungeCount     ;
    incf    IncCount,1      ;
    movlw   0xa             ;
    subwf   IncCount,0      ; check if DecCount is >10
    btfss   STATUS,C        ; if not, get out of ad ops
    goto    ad_done                 ;
    clrf    IncCount        ; if it is >10, clear DecCount
    movlw   0xff            ;
    subwf   PWMVal,0        ;
    btfsc   STATUS,Z        ;
    goto    ad_done                 ;
    incf    PWMVal,1        ; decrement PWMVal, put back in PWMVal
    incf    LeapCount,f     ; increment PlungeCount
    movlw   0xc             ;
    subwf   LeapCount,w     ; check if LeapCount>12 -> w=LeapCount–12 -> if
```

-continued

```
LeapCount<12, C=0
    btfss   STATUS,C        ; if not, get out of ad ops
    goto    ad_done         ;
    movlw   0xd0            ; if PWMVal > 0xd0, don't sub 10
    subwf   PWMVal,w        ; w=PWMVal-d0. if PWMVal>d0, C=1, and get out.
    btfsc   STATUS,C        ;
    goto    ad_done         ;
    movlw   0x9             ;
    addwf   PWMVal,f        ; PWMVal = PWMVal - 9
ad_done:
    comf    PWMVal,0        ; complement PWMVal and store result in w reg
    movwf   PWMRem          ;
; if LITEON is high or if AWAKE is low or if BLANK is high,
; must increment CountLo and CountHi
    btfsc   State,LITEON    ; if LITEON is high, jump to counup
    goto    countup         ;
    btfss   State,AWAKE     ; if AWAKE is low, jump to countup
    goto    countup         ;
    btfsc   State,BLANK     ; if BLANK is high, jump to countup
    goto    countup         ;
    goto    nocount         ; if neither condition is met, go to nocount
countup
    movlw   0xff            ;
    subwf   CountLo,0       ; W=CountLo-255. Z=1 if CountLo=255
    btfss   STATUS,Z        ; if Z is clear, skip incrementing CountHi
    goto    lo_only         ;
    incf    CountHi,1       ;
lo_only
    incf    CountLo,1       ;
    incf    BlankCnt,1      ;
nocount
; if CHECKING is high, increment CheckCnt
    btfss   State,CHECKING  ;
    goto    checklo         ;
    incf    CheckCnt,1      ;
; check if CHECKING period (one second) is over - if so, clear CHECKING,
; and if PWMVal is higher (meaning it got darker in the second since a pulse
was sent),
; then send another pulse
    movlw   0x64            ; 100 in hex
    subwf   CheckCnt,0      ; w = CheckCnt-100. C=0 if CheckCnt<100
    btfss   STATUS,C        ; if C=1, go to check PWMVal against StoredPWM
    goto    checklo         ;
    btfss   State,LITEON    ; if LITEON is high, do the "want light on"
version
    goto    liteonlo        ;
; if LITEON is high, do the following
    movf    PWMVal,0        ; move PWMVal into w
    subwf   StoredPWM,0     ; w = StoredPWM-PWMVal. C=0 if StoredPWM<PWMVal
    btfss   STATUS,C        ; if C=1 (got lighter), don't send pulse again
    bsf     PORTC,PULSEOUT  ;
    goto    clrcheck        ;
; if LITEON is low, do the following
liteonlo:
    movf    StoredPWM,0     ; move StoredPWM into w
    subwf   PWMVal,0        ; w = PWMVal-StoredPWM. C=0 if PWMVal<StoredPWM
    btfss   STATUS,C        ; if C=1 (got darker), don't send pulse again
    bsf     PORTC,PULSEOUT  ;
clrcheck:
    bcf     State.CHECKING  ;
    bcf     PORTC,TESTP6    ;
    clrf    CheckCnt        ;
checklo:
; check if awake - if not, check if it's time. if not, go to top.
    btfsc   State,AWAKE     ; if AWAKE is high, go to other stuff. if not, check
counter
    goto    already_awake   ;
; check test pin - if low, go to set_awake
; old line below, started in 5 minutes
;   movlw   0x76            ; corresponds to 118d, timeout of 5 minutes
    movlw   0x23            ; corresponds to 35d, timeout of 90 seconds
    btfss   PORTB,2         ;
    goto    set_awake       ;
    subwf   CountHi,0       ;
    btfss   STATUS,Z        ; if CountHi != 35, go to main_loop again
    goto    main_loop       ;
```

-continued

```
; if time to go awake, set AWAKE, clear timers, and go to top
set_awake
    bsf     State,AWAKE     ; set AWAKE bit
    bsf     PORTB,TESTP13       ; set external test pin 13
    clrf    CountLo             ;
    clrf    CountHi             ;
    goto    main_loop       ;
already_awake       nop
; check PULSEOUT - if set, increment PWCount
    btfss   PORTC,PULSEOUT      ; if PULSEOUT is not set, go to next section
    goto    exit_pulse          ;
    incf    PWCount,1       ;
; check if timeout has been reached, if so then clear it
    movlw   0x14            ; move 20d into W
    subwf   PWCount,0       ; if same, Z==1
    btfss   STATUS,Z        ;
    goto    exit_pulse      ;
    bcf     PORTC,PULSEOUT      ;
    clrf    PWCount             ;
exit_pulse  nop             ;
; check if BLANK is high - if so, ignore PIR and check if it's time to drop
; BLANK
    btfsc   State,BLANK     ;
    goto    check_blank     ;
; check PIR inputs - if active, clear out CountLo and CountHi
    btfss   PORTC,PIRL      ;
    goto    presence
    btfsc   PORTC,PIRH
    goto    presence
    goto    quiet
presence
    incf    PresCnt,1       ;
; if PresCnt > 2, perform ops - otherwise, go back to main loop
    molvw   s
    subwf   PresCnt,0       ; W = PresCnt-10. C=0 if PresCnt < 10
    btfss   STATUS,C        ; check C, if set then skip goto, otherwise loopback
    goto    main_loop       ;
    clrf    CountHi
    clrf    PresCnt
; check if LITEON - if not, check Dark - if dark, make pulse
    btfsc   State,LITEON            ; if LITEON is set, jump to top
    goto    main_loop
; check if PWMVal>128 - if so, set LITEON and call pulse program
    movlw   0x80            ;
    subwf   PWMVal,0        ; W = PWMVal-0x80. C=0 if PWMVal<0x80
    btfss   STATUS,C        ; if C is set, generate pulse - otherwise, back to top
    goto    main_loop       ;
    call    query_lite      ; test function for the moment @@@
; if RS232OK is low, set LITEON, set pulseout, save PWMVal in StoredPWM, and set
CHECKING
    btfsc   State,RS232OK           ;
    goto    rs_set              ;
    bsf     State,LITEON            ;
    bsf     PORTC,PULSEOUT      ;
    movf    PWMVal,0        ;
    movwf   StoredPWM       ;
    bsf     State,CHECKING          ;
    goto    main_loop       ;
; if RS232OK is high, check if WORKLIGHT is low, if so then set pulseout and
LITEON. then go back to top
rs_set:
    clrf    BlankCnt        ;
    bsf     State,BLANK     ; setting BLANK here stops oscillations
    btfsc   State,WORKLIGHT     ;
    goto    main_loop       ;
    bsf     State,LITEON            ;
    bsf     PORTC,PULSEOUT      ;
    goto    main_loop       ;
check_blank
    movlw   0xff            ; if BLANK has been high for 2.5 seconds,
    subwf   BlankCnt,0      ; shut if off
    btfss   STATUS,Z        ;
    goto    quiet           ;
    bcf     State,BLANK     ;
    bcf     PORTC,TEST2     ; clear external test pin 5
quiet:
    clrf    PresCnt             ;
```

-continued

```
; if PIR inputs are inactive, check if CountHi==118. if so, clear out LITEON
and pulse
    btfss   State,LITEON        ;
    goto    main_loop       ;
    movlw   0x8d            ; 141d, equal to 6 minutes
    btfss   PORTB,2             ; if test pin is low, load up 2 as test for
CountHi
    movlw   0x2             ;
    subwf   CountHi,0       ; if CountHi==141, then Z=1
    btfss   STATUS,Z        ;
    goto    main_loop       ;
    clrf    CountHi             ;
    clrf    CountLo             ;
    bcf     State,LITEON        ;
    bsf     State,BLANK     ;
    clrf    BlankCnt        ;
    call    query_lite      ;
; if RS232OK is low, set pulseout, set StoredPWM equal to PWMVal, set CHECKING,
got to top
    btfsc   State,RS232OK       ;
    goto    rs_clr              ;
    bsf     PORTC,PULSEOUT      ;
    movf    PWMVal,0        ;
    movwf   StoredPWM       ;
    bsf     State,CHECKING      ;
    goto    main_loop       ;
; if RS232OK is high, check if WORKLIGHT is high, if so then set pulseout. then
go back to top
rs_clr:
    btfsc   State,WORKLIGHT     ;
    bsf     PORTC,PULSEOUT      ;
    goto    main_loop       ;
query_lite:
    bcf     State,WORKLIGHT     ;
; look for key reading pulse, stay until seen
waittillo:
    btfsc   PORTB,1             ; read pin 12, RB1
    goto    waittillo       ;
waittilhi:
    btfss   PORTB,1             ; read pin 12, RB1
    goto    waittilhi       ;
; reset timer, timer bits are 32us/bit
    clrf    TMR0            ; clear out TMR0 to start timer again
; wait 500 us
wait500:
    movlw   0x10            ;
    subwf   TMR0,0              ; check if TMR0 = 15 (time = 512us)
    btfss   STATUS,Z        ;
    goto    wait500             ; if not yet, check again
    clrf    TMR0            ; clear timer
; send 0x3a
; turn pin 6 on for 1666 us,
;               off for 833us,
;               on for 833us,
;               off for 2499us,
;               on for 1666us.
    bsf     PORTC,RS232DRV      ;
wait1:
    movlw   0x33            ;
    subwf   TMR0,0              ; check if TMR0 = 51 (time = 1664us)
    btfss   STATUS,Z        ;
    goto    wait1           ; if not yet, check again
    clrf    TMR0            ;
    bcf     PORTC,RS232DRV      ;
wait2:
    movlw   0x19            ;
    subwf   TMR0,0              ; check if TMR0 = 26 (time = 832us)
    btfss   STATUS,Z        ;
    goto    wait2           ; if not yet, check again
    clrf    TMR0            ;
    bsf     PORTC,RS232DRV      ;
wait3:
    movlw   0x19            ;
    subwf   TMR0,0              ; check if TMR0 = 26 (time = 832us)
    btfss   STATUS,Z        ;
    goto    wait3           ; if not yet, check again
    clrf    TMR0            ;
    bcf     PORTC,RS232DRV      ;
```

-continued

```
wait4:
    movlw   0x4d            ;
    subwf   TMR0,0                  ; check if TMR0 = 78 (time = 2496us)
    btfss   STATUS,Z        ;
    goto    wait4           ; if not yet, check again
    clrf    TMR0            ;
    bsf     PORTC,RS232DRV      ;
wait5:
    movlw   0x4d            ;
    subwf   TMR0,0                  ; check if TMR0 = 78 (time = 2496us)
    btfss   STATUS,Z        ;
    goto    wait5           ; if not yet, check again
    clrf    TMR0            ;
    bcf     PORTC,RS232DRV      ;
; wait for 100 us for pin 12 to rise before checking
wait6:
    movlw   0x3             ;
    subwf   TMR0,0                  ; check if TMR0 = 3 (time = 96us)
    btfss   STATUS,Z        ;
    goto    wait6           ; if not yet, check again
    clrf    TMR0            ;
; wait for pin 12 to drop low - if it drops for more than 500 us, then
; RS-232 is active. If it stays low for less than 500us, RS-232 is
; inactive.
checkp12:
    btfsc   PORTB,1                 ; read pin 12, RB1
    goto    checkp12        ;
    clrf    TMR0            ; reset counter to start measuring low pw
    bsf     State,RS232OK           ;
; first time high is seen, check if time > 512us, or 16 counts. If so, set
RS232OK.
; also check if time = 2912us, or 91 counts. If it is, sample pin12 and pass to
WORKLIGHT. Exit.
reading:
    btfss   PORTB,1                 ;
    goto    p121o           ;
    movlw   0x10            ;
    subwf   TMR0,0                  ; W=TMR0−0x10. If TMR0<10, then C=0
    btfsc   STATUS,C        ;
    goto    p121o           ;
    bcf     State,RS232OK           ;
p121o;
    movlw   0x56            ;
    subwf   TMR0,0                  ;
    btfss   STATUS,Z        ;
    goto    reading                 ;
; sample pin 12, set WORKLIGHT if HIGH
    btfsc   PORTB,1                 ;
    bsf     State,WORKLIGHT         ;
    clrf    TMR0            ;
; wait for end of signal from GDO
restofrx:
    movlw   0xc8            ;
    subwf   TMR0,0                  ;
    btfss   STATUS,Z        ;
    goto    restofrx        ;
    clrf    TMR0            ;
; send break
    bsf     PORTC,RS232DRV      ;
break1:
    movlw   0xff            ;
    subwf   TMR0,0                  ;
    btfss   STATUS,Z        ;
    goto    break1          ;
    clrf    TMR0            ;
break2:
    movlw   0x20            ;
    subwf   TMR0,0                  ;
    btfss   STATUS,Z        ;
    goto    break2          ;
    bcf     PORTC,RS232DRV      ;
    retlw   0               ;
            END                     ; directive 'end of program'
```

What is claimed is:

1. A wall control unit for a movable barrier operator for sending baseband signals to a head unit of a movable barrier operator to command the movable barrier to perform barrier operator functions, comprising:

a wall control unit port for connection to a wired connection to a head unit of a movable barrier operator;

a first switch for sending a barrier command signal to the head unit commanding the head unit to open or close a movable barrier;

a second switch for commanding the head unit to provide energization to a light source; and a passive infrared detector for causing a command signal to be sent to the head unit to control the illumination state of the light source.

2. The wall control unit of claim 1, wherein the command signal caused by the passive infrared detector is transmitted through the wired connection.

3. The wall control unit of claim 1, wherein the wired connection is a conventional signaling channel for communicating between the wall unit and the head unit.

4. The wall control unit of claim 3, wherein the passive infrared detector is operably connected to the wired connection to enable the passive infrared detector to communicate with the head unit using the conventional signaling channel.

5. The wall control unit of claim 4, wherein the passive infrared detector is retrofitted onto the wall control unit.

6. The wall control unit of claim 3, wherein the passive infrared detector is configured to control any selected head unit that communicates using a conventional signaling channel.

7. A movable barrier operator having an illumination controller, comprising:

a head unit of a movable barrier operator to command the movable barrier to perform barrier operator functions;

a wall control unit for sending baseband signals to the head unit via a communications port, wherein the wall control unit further includes a first switch for sending a first barrier command signal to the head unit commanding the head unit to open or close a movable barrier and a second switch for sending a second barrier command signal to the head unit to energize a light source;

a communication pathway between the wall control communications port and the head unit; and a passive infrared detector for causing a command signal to be sent to the head unit over the communications pathway to control the illumination state of a light source.

8. The movable barrier operator of claim 7, wherein the communications pathway is a conventional signaling channel for use by the wall control unit to communicate with the head unit.

9. The movable barrier operator of claim 8, wherein the passive infrared detector is able to control any head unit configured to communicate using the conventional signaling channel.

10. The movable barrier operator of claim 8, wherein the communication pathway is a wire connection.

11. The movable barrier operator of claim 7, wherein the first switch, the second switch and the passive infrared detector are colocated on the wall control unit and communicate with the head unit over the signaling channel.

12. A wall control unit for a movable barrier operator for sending baseband signals to a head unit of a movable barrier operator to command the movable barrier to perform barrier operator functions, comprising:

a wall control unit port for connection to a wired connection to a head unit of a movable barrier operator;

a first switch for sending a first barrier command signal to the head unit commanding the head unit to open or close a movable barrier;

a second switch for sending a second barrier command signal to the head unit to energize a light source; and a passive infrared detector for causing a command signal to be sent to the head unit to control the light source.

* * * * *